US012049823B2

(12) United States Patent
McCullough et al.

(10) Patent No.: US 12,049,823 B2
(45) Date of Patent: Jul. 30, 2024

(54) DRILLING APPARATUS AND METHOD FOR USE WITH ROTATING DRILL PIPE

(71) Applicant: NTS Amega West USA, Inc, Houston, TX (US)

(72) Inventors: Robert McCullough, Spruce Grove (CA); Adam Well, Spring, TX (US); Everett Hagar, Devon (CA); Daniel Minett-Smith, Gloucester (GB); Robert Sedgeman, Gloucester (GB)

(73) Assignee: NTS Amega West USA, Inc., Houston, TX (US)

( * ) Notice: Subject to any disclaimer, the term of this patent is extended or adjusted under 35 U.S.C. 154(b) by 92 days.

(21) Appl. No.: 17/779,271

(22) PCT Filed: Apr. 3, 2020

(86) PCT No.: PCT/CA2020/050442

§ 371 (c)(1),
(2) Date: May 24, 2022

(87) PCT Pub. No.: WO2021/151189

PCT Pub. Date: Aug. 5, 2021

(65) Prior Publication Data

US 2022/0412167 A1 Dec. 29, 2022

Related U.S. Application Data

(60) Provisional application No. 62/968,812, filed on Jan. 31, 2020.

(51) Int. Cl.
*E21B 7/06* (2006.01)
*E21B 17/05* (2006.01)

(52) U.S. Cl.
CPC ..... *E21B 7/067* (2013.01); *E21B 17/05* (2013.01)

(58) Field of Classification Search
CPC ..... E21B 7/067; E21B 17/05; E21B 4/003; E21B 17/10
See application file for complete search history.

(56) References Cited

U.S. PATENT DOCUMENTS 4,971,158 A 11/1990 Salmi
5,181,576 A 1/1993 Askew et al.
(Continued)

FOREIGN PATENT DOCUMENTS

CA 2494237 C 12/2002
CA 2561036 A1 10/2005
(Continued)

OTHER PUBLICATIONS

"International Search Report and Written Opinion mailed Oct. 16, 2020 in corresponding International Application No. PCT/CA2020/050442 with the International Filing Date of Apr. 3, 2020".
(Continued)

*Primary Examiner* — Tara Schimpf
*Assistant Examiner* — Jennifer A Railey
(74) *Attorney, Agent, or Firm* — ALG Intellectual Property, LLC

(57) ABSTRACT

A drilling apparatus connectable with a drill pipe and connectable with a drilling assembly comprising a drilling assembly housing, for use in drilling a borehole, including a rotation restraining device actuatable between a retracted position and an extended position, a rotation restraining device actuator for actuating the rotation restraining device between the retracted position and the extended position, a swivel actuatable between a locked position and an unlocked position, and a swivel actuator for actuating the swivel between the locked position and the unlocked position. A method for drilling a borehole, including connecting a drilling assembly with a drill pipe, wherein the drilling
(Continued)

assembly comprises a drilling assembly housing, drilling while rotating the drill pipe and thereby rotating the drilling assembly housing, and drilling while rotating the drill pipe relative to the drilling assembly housing.

30 Claims, 11 Drawing Sheets

(56) References Cited

U.S. PATENT DOCUMENTS

| | | | |
|---|---|---|---|
| 5,421,421 | A | 6/1995 | Appleton |
| 5,738,178 | A | 4/1998 | Williams et al. |
| 6,082,457 | A | 7/2000 | Best et al. |
| 6,158,533 | A | 12/2000 | Gillis et al. |
| 6,227,313 | B1 | 5/2001 | Davis et al. |
| 6,328,119 | B1 | 12/2001 | Gillis et al. |
| 6,439,321 | B1 | 8/2002 | Gillis et al. |
| 6,446,737 | B1 | 9/2002 | Fontana et al. |
| 7,178,611 | B2 | 2/2007 | Zupanick |
| 7,467,658 | B2 | 12/2008 | Kent et al. |
| 7,467,672 | B2 | 12/2008 | Cruickshank |
| 7,681,650 | B2 | 3/2010 | Telfer et al. |
| 7,987,927 | B2 | 8/2011 | Downton |
| 8,307,921 | B2 | 11/2012 | Eddison |
| 8,448,722 | B2 | 5/2013 | Konschuh et al. |
| 8,789,579 | B2 | 7/2014 | Ollerenshaw et al. |
| 8,869,916 | B2 | 10/2014 | Clausen et al. |
| 9,016,400 | B2 | 4/2015 | Clausen et al. |
| 9,376,865 | B2 | 6/2016 | Kirkhope et al. |
| 9,797,204 | B2 | 10/2017 | Kirkhope |
| 10,047,573 | B2 | 8/2018 | Kadam et al. |
| 10,066,438 | B2 * | 9/2018 | Kirkhope ..... E21B 7/062 |
| 10,280,700 | B2 | 5/2019 | Moyes |
| 10,358,903 | B2 | 7/2019 | Smith |
| 10,597,943 | B2 | 3/2020 | Wheeler et al. |
| 10,648,265 | B2 | 5/2020 | Kinsella et al. |
| 10,883,316 | B2 | 1/2021 | Samuel et al. |
| 10,968,722 | B2 | 4/2021 | Buckland et al. |
| 2007/0012440 | A1 | 1/2007 | Lee |
| 2008/0236481 | A1 | 10/2008 | Petersen et al. |
| 2011/0214963 | A1 | 9/2011 | Beylotte et al. |
| 2011/0284292 | A1 | 11/2011 | Gibb et al. |
| 2013/0248203 | A1 | 9/2013 | Scott et al. |
| 2014/0231144 | A1 | 8/2014 | Sonar et al. |
| 2014/0284110 | A1 | 9/2014 | Savage et al. |
| 2018/0163509 | A1 | 6/2018 | Churchill |
| 2020/0263507 | A1 | 8/2020 | Crowther et al. |

FOREIGN PATENT DOCUMENTS

| | | | |
|---|---|---|---|
| CA | 2568053 | A1 | 5/2007 |
| CA | 3009888 | A1 | 7/2017 |
| CA | 2995267 | A1 | 9/2018 |
| EP | 1398455 | B1 | 3/2004 |
| EP | 2923025 | A1 | 9/2015 |
| EP | 3397832 | A1 | 11/2018 |
| WO | 2011109075 | A2 | 9/2011 |
| WO | WO-2019100116 | A1 * | 5/2019 ..... E21B 17/1014 |
| WO | 2021151189 | A1 | 8/2021 |

OTHER PUBLICATIONS

International Search Report and Opinion issued on International PCT Patent Application No. PCT/CA2020/050442 Published Aug. 5, 2021.

Print out of <https://web.archive.org/web/20181220165500/http://www.rubicon-oilfield.com:80/products/casingswivel/> archived as published on Dec. 20, 2018.

Print out of <https://onepetro.org/SPEADIP/proceedings-abstract/17ADIP/2-17ADIP/D021S046R002/193637> published Nov. 13, 2017.

Operator Drills Gulf of Thailand's Longest Openhole Production Section in One Run, Halliburton, Nov. 11, 2018.

Arrival Technology Forum Featuring Mud Motors, "Rotary Bottom Hole Assemblies," Nov. 1, 2018.

* cited by examiner

DRILLING APPARATUS AND METHOD FOR USE WITH ROTATING DRILL PIPE

TECHNICAL FIELD

A drilling apparatus and method for use with rotating drill pipe.

BACKGROUND OF THE INVENTION

A borehole may be drilled using a drill string. A drill string may comprise a length of drill pipe which extends from a drilling rig into the borehole being drilled. The drilling rig may support the drill string adjacent to a proximal end of the drill pipe, and a bottom-hole assembly may be connected with a distal end of the drill pipe. A drill string may comprise a drill bit which may be positioned at a distal end of the drill string.

In a conventional drill string, the drill pipe and the bottom-hole assembly are fixedly connected with each other so that they rotate together, and the drill pipe may or may not be rotated during drilling. In "rotary drilling" with a conventional drill string, the drill pipe, the bottom-hole assembly, and the drill bit are all rotated by the drilling rig. In "sliding drilling" with a conventional drill string, the drill pipe is not rotated by the drilling rig, and the bottom-hole assembly may comprise a drilling motor which rotates or reciprocates the drill bit relative to the drill pipe. In a hybrid form of drilling with a conventional drill string, sometimes referred to as "performance drilling", the drill pipe and the bottom-hole assembly are rotated by the drilling rig while the drill bit is simultaneously rotated or reciprocated relative to the drill pipe by a drilling motor which is a component of the bottom-hole assembly.

In drilling with a conventional drill string, drilling performance may be dependent in part upon the "weight-on-bit" (i.e., force) which is applied to the end of the borehole by the drill bit during drilling. Weight-on-bit may be controlled to some extent during drilling by controlling the amount of support that is provided to the drill string by the drilling rig.

The maximum possible weight-on-bit is typically limited to the weight of the drill string, and may be reduced by the effects of friction and/or other interaction between the drill string and the borehole. One described advantage of rotary drilling over sliding drilling is that dynamic friction (resulting from rotation of the drill pipe during rotary drilling) is typically less than static friction (resulting from sliding drilling), which may result in less reduction in weight-on-bit due to friction during rotary drilling than during sliding drilling. Another possible advantage of rotary drilling over sliding drilling is that overall drilling performance may be better during rotary drilling than during sliding drilling.

Drilling a borehole may include "non-directional drilling" and/or "directional drilling". In non-directional drilling, the goal may be to drill a straight or nearly straight wellbore and controlling the drilling direction to achieve the straight or nearly straight wellbore may comprise or mainly consist of managing the weight-on-bit and other drilling parameters during drilling. In directional drilling, the goal may be to steer toward a subterranean target with the wellbore, and controlling the drilling direction to achieve the subterranean target may comprise steering the drill bit as the borehole is drilled.

Non-directional drilling with a conventional drill string may be performed by rotary drilling, by sliding drilling, or by performance drilling.

Directional drilling with a conventional drill string typically involves the use of a bottom-hole assembly which includes a steerable drilling system. For example, directional drilling while rotary drilling may be performed using a rotary steerable drilling tool, while directional drilling while sliding drilling may be performed using a steerable drilling motor.

A rotary steerable drilling tool typically includes a shaft and a housing. The shaft is fixedly connected between the drill pipe and the drill bit so that rotating the drill pipe rotates the drill bit. The housing surrounds the shaft such that the shaft is rotatable relative to the housing.

In a push-the-bit rotary steerable drilling tool, the housing is configured to apply a lateral force to the drill bit so that the side of the drill bit pushes against the borehole in a desired direction. In a point-the-bit rotary steerable drilling tool, the housing is configured to bend or pivot the shaft so that the drill bit points in a desired direction.

In a partially-rotating rotary steerable drilling tool, the housing is typically configured to resist rotation relative to the borehole in order to maintain the position of the housing relative to the borehole. For example, the housing may be configured as an "anti-rotation housing" and may comprise one or more members for engaging the borehole in order to restrain the housing from rotating relative to the borehole. In some push-the-bit rotary steerable drilling tools, the one or more engaging members may be configured to selectively engage the borehole in order to push the drill bit in a desired direction.

In a fully-rotating rotary steerable drilling tool, the housing is typically configured to rotate relative to the shaft in order to maintain the position of the housing relative to the borehole. For example, the housing may be configured to rotate relative to the shaft in the opposite direction and at the same rotation rate as the shaft is being rotated by the drill pipe so that the housing is maintained in a "geosynchronous" orientation relative to the borehole.

In summary, in directional drilling while rotary drilling with a rotary steerable drilling tool, since the housing of the rotary steerable drilling tool is typically rotatable relative to the shaft, the desired direction of the drill bit can typically be maintained generally during drilling by maintaining the position of the housing relative to the borehole, which may be complicated by the forces and conditions to which the housing may be subjected as it travels through the borehole and during drilling.

A drilling motor typically includes a housing which is fixedly connected directly or indirectly with the drill pipe so that the housing rotates with the drill pipe, a power section which provides the energy to rotate or reciprocate the drill bit, and a shaft within the housing which is connected between the power section and the drill bit in order to transmit the energy from the power section to the drill bit.

In a steerable drilling motor, the drilling motor is typically configured to apply a lateral force to the drill bit so that the side of the drill bit pushes against the borehole in a desired direction or the drilling motor is configured to bend or pivot the shaft so that the drill bit points in a desired direction. For example, the housing may include an external or internal bend, or the drilling motor may comprise a mechanism for pushing, bending, or pivoting the shaft in a desired direction.

In directional drilling while sliding drilling with a steerable drilling motor, since the housing of the drilling motor is fixedly connected with the drill pipe, the desired direction of the drill bit can typically be maintained generally during drilling by maintaining the position of the drill pipe and the housing relative to the borehole, which may be complicated by the forces and conditions to which the drill pipe and the housing may be subjected as they travel through the borehole and during drilling.

Because of the perceived advantages of rotary drilling over sliding drilling, rotary drilling is generally preferred over sliding drilling, and directional drilling while rotary drilling with a rotary steerable drilling device is generally preferred over directional drilling while sliding drilling with a steerable drilling motor.

More particularly, drilling using a rotary steerable drilling tool may exhibit the following characteristics:

1. since the drill pipe is always rotating, a rotary steerable drilling tool allows for continuous "on the fly" steering, which may result in reduced tortuosity of the borehole;
2. since the drill pipe is always rotating, the drag on the drill pipe due to friction and/or other interaction between the drill pipe and the borehole may be reduced, allowing for higher weight-on-bit and possible overall improved drilling performance, especially in highly directional drilling applications involving long lateral boreholes and extended-reach boreholes;
3. continuous rotation of the drill pipe may result in improved transportation of drill bit cuttings through the borehole to the surface, potentially resulting in improved hydraulic performance during drilling; and
4. the overall costs associated with using a rotary steerable drilling tool can be very high, due to the cost of the tool and its associated components in the bottom-hole assembly, the cost of operating the tool, and the potential lost-in-hole cost.

More particularly, drilling using a steerable drilling motor may exhibit the following characteristics:

1. rotary drilling (or performance drilling) is typically performed for non-directional drilling. The drag on the drill pipe due to dynamic friction and/or other interactions between the drill string and the borehole may be relatively low and overall drilling performance (such as rate of penetration) may be relatively high, but control over the drilling direction is limited;
2. sliding drilling is typically performed for directional drilling. The drag on the drill pipe due to static friction and/or other interactions between the drill pipe and the borehole is relatively high and overall drilling performance (such as rate of penetration) is typically compromised in order to provide control over the drilling direction;
3. a combination of rotary drilling (or performance drilling) and sliding drilling is typically required in order to complete a well plan successfully. The need to switch between rotary drilling for non-directional drilling and sliding drilling for directional drilling typically results in lower overall drilling performance (such as rate of penetration) relative to the overall drilling performance using a rotary steerable drilling tool; and
4. the overall costs associated with using a steerable drilling motor may generally be much lower relative to the costs associated with using a rotary steerable drilling tool, as a trade-off for the relatively lower overall drilling performance.

There remains a need for drilling apparatus and methods which can provide some or all of the benefits of rotary drilling without the use of a rotary steerable drilling tool.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

References in this document to "proximal" mean located relatively toward an intended "uphole" end, "upper" end, and/or "surface" end of a borehole or of an object positioned in a borehole, unless expressly stated otherwise.

References in this document to "distal" mean located relatively away from an intended "uphole" end, "upper" end, and/or "surface" end of a borehole or of an object positioned in a borehole, unless expressly stated otherwise.

This description relates to a drilling apparatus for use in drilling a borehole and to a method for drilling a borehole.

The drilling apparatus may be deployed in any suitable manner. As a non-limiting example, the drilling apparatus may be included as a component of a drill string. The drill string may comprise drill pipe. The drill string may comprise a bottom-hole assembly. The drill string may comprise a drill bit.

The drill string may be configured for rotary drilling wherein the drill pipe is rotating and/or the drill string may be configured for sliding drilling wherein the drill pipe is not rotating.

The drill string may be used for non-directional drilling and/or for directional drilling. In some particular embodiments, the drill string may be used for non-directional drilling. In some particular embodiments, the drill string may be used for non-directional drilling during which the drill pipe is rotating. In some particular embodiments, the drill string may be used for directional drilling. In some particular embodiments, the drill string may be used for directional drilling during which the drill pipe is rotating.

The drill pipe may comprise, consist of, or consist essentially of any structure or combination of structures which are suitable for deployment in a borehole. As non-limiting examples, the drill pipe may comprise a plurality of lengths or joints of drill pipe connected together or may comprise a coiled tubing. The lengths or joints of drill pipe may be connected together with threaded connections or in any other suitable manner.

The drill pipe may have a proximal end which may be adapted to be supported by a drilling rig. The drilling rig may comprise any type of drilling rig which is suitable for use with the drill string. As non-limiting examples, the drilling rig may be a land-based drilling rig or the drilling rig may be an offshore drilling rig. The drilling rig may be configured to rotate the drill pipe. The drilling rig may be configured to rotate the drill pipe in any suitable manner. As non-limiting examples, the drilling rig may be configured to rotate the drill pipe using a top drive or a rotary table.

The bottom-hole assembly may be connected directly or indirectly with the drill pipe. As a non-limiting example, the drill pipe may have a distal end and the bottom-hole assembly may be connected directly or indirectly with the distal end of the drill pipe. The bottom-hole assembly may have a proximal end and in some embodiments, the proximal end of the bottom-hole assembly may be connected directly or indirectly with the distal end of the drill pipe.

The bottom-hole assembly may include any structures, devices or apparatus which may be desirable and/or advantageous to include in a drill string. As non-limiting examples, the bottom-hole assembly may comprise one or more drill collars, stabilizers, reamers, drilling jars, shock tools, MWD or other communication systems, sensors, instruments, valves, turbines, batteries, processors, and/or drilling motors.

The drill bit may be connected with or otherwise positioned at the distal end of the drill string. In some embodiments, the bottom-hole assembly may have a distal end and the drill bit may be connected directly or indirectly with the distal end of the bottom-hole assembly. The drill bit may comprise any type of drill bit, including as non-limiting examples, a rotary cutter bit, a fixed cutter bit, a coring bit, or a reciprocating/percussion bit.

The drilling apparatus may consist of a single integrated component, or the drilling apparatus may consist of a plurality of drilling apparatus components which may be connected together directly or indirectly.

When deployed as a component of a drill string, the drilling apparatus may be included as a component of the drill string in any suitable manner. The drilling apparatus may be included as one or more components of the drill string. In some embodiments, the drilling apparatus may be connectable directly or indirectly with the drill pipe, the bottom-hole assembly, and/or with any other component or components of the drill string. In some embodiments, the drilling apparatus may be included as one or more components of the bottom-hole assembly. In some embodiments, one or more drilling apparatus components may be separate from the bottom-hole assembly. In some embodiments, one or more drilling apparatus components and one or more components of the bottom-hole assembly may be interposed between each other.

The drilling apparatus comprises a rotation restraining device and a swivel. In some embodiments, the drilling apparatus may be configured for use with a drilling assembly which is a component of the bottom-hole assembly. In some embodiments, the drilling apparatus may comprise a drilling assembly. In some embodiments, the rotation restraining device may be actuatable between a retracted position and an extended position. In some embodiments, the swivel may be actuatable between a locked position and an unlocked position.

The drilling apparatus may comprise a drilling apparatus housing. The drilling apparatus housing may comprise a single housing component or may comprise a plurality of housing components. Drilling apparatus housing components may be integral with each other or may be connected together in any suitable manner, including as non-limiting examples, with a threaded connection, with an interference fit, or by welding. The drilling apparatus housing may be connectable directly or indirectly with the drill pipe, with the bottom-hole assembly, and/or with any other component or components of the drill string.

The drilling assembly may be a non-directional drilling assembly or may be a directional drilling assembly. In some particular embodiments, the drilling assembly may be a directional drilling assembly for use in directional drilling.

The drilling assembly may comprise a drilling assembly housing. The drilling assembly housing may be an integral section of the drilling apparatus housing or may be a housing component of the drilling apparatus housing. The drilling assembly housing may comprise a single housing component or may comprise a plurality of drilling assembly housing components. Drilling assembly housing components may be integral with each other or may be connected together in any suitable manner, including as non-limiting examples, with a threaded connection, with an interference fit, or by welding.

In some embodiments, the drilling assembly may comprise, consist of, or consist essentially of a drilling motor. The drilling motor may be any drilling motor which is suitable for use in drilling a borehole. As non-limiting examples, the drilling motor may be a progressing cavity motor (PCM), a turbine, or a reciprocating motor. The drilling motor may be a non-steerable drilling motor or may be a steerable drilling motor.

In some particular embodiments, the drilling motor may comprise a progressing cavity motor (PCM) comprising a drilling assembly housing and a driveshaft rotatably supported within the drilling assembly housing. The driveshaft may comprise a single driveshaft component or may comprise a plurality of driveshaft components. Driveshaft components may be integral with each other or may be connected together in any suitable manner, including as non-limiting examples, with a threaded connection, with an interference fit, or by welding. The driveshaft may be connectable directly or indirectly with a drill bit.

In a particular non-limiting aspect, the drilling apparatus may be connectable with a drill string and connectable with a drilling assembly comprising a drilling assembly housing, for use in drilling a borehole, and may comprise:

- a rotation restraining device actuatable between a retracted position and an extended position, wherein the rotation restraining device is connected with the drilling assembly housing such that rotation of the drilling assembly housing relative to the borehole is inhibited when the drilling apparatus is in the borehole and the rotation restraining device is in the extended position;
- a rotation restraining device actuator for actuating the rotation restraining device between the retracted position and the extended position;
- a swivel actuatable between a locked position and an unlocked position, wherein the drilling assembly housing is rotatable with the drill string when the swivel is in the locked position, and wherein the drill string is rotatable relative to the drilling assembly housing when the swivel is in the unlocked position; and
- a swivel actuator for actuating the swivel between the locked position and the unlocked position.

In some embodiments, the drilling apparatus may comprise the drilling assembly. In some embodiments, the drilling assembly may comprise a directional drilling assembly for use in directional drilling. The directional drilling assembly may be capable of defining a toolface direction for directional drilling.

A directional drilling assembly may define a toolface direction in any suitable manner. As non-limiting examples, the drilling assembly housing of a directional drilling assembly may include an external or internal bend, or a directional drilling assembly may comprise a mechanism for pushing, bending, or pivoting the shaft in the desired direction.

In some embodiments, the drilling assembly may comprise, consist of, or consist essentially of a drilling motor. In some embodiments in which the drilling assembly is a directional drilling assembly, the drilling motor may be a steerable drilling motor which is capable of defining a toolface direction for directional drilling.

The drilling apparatus has a proximal end and a distal end. The components of the drilling apparatus are axially located between the proximal end and the distal end of the drilling apparatus. In some embodiments, only components of the drilling apparatus are axially located between the proximal end and the distal end of the drilling apparatus. In some embodiments, one or more other components of the drill string may be axially located between the proximal end and the distal end of the drilling apparatus. In some embodiments, one or more components of the bottom-hole assembly may be axially located between the proximal end and the distal end of the drilling apparatus. As a result, the proximal end of the drilling apparatus may be considered to be the most proximal axial location of components of the drilling apparatus within the drill string and the distal end of the drilling apparatus may be considered to be the most distal axial location of components of the drilling apparatus within the drill string.

The drilling apparatus may be configured so that the swivel is axially located more proximally within the drill string than the drilling assembly and the rotation restraining device so that the drilling assembly and the rotation restraining device are axially located between the swivel and the distal end of the drilling apparatus. In some particular embodiments, the rotation restraining device may be axially located between the swivel and the drilling assembly. In some particular embodiments, the drilling assembly may be axially located between the swivel and the rotation restraining device.

The swivel may comprise any structure, device or apparatus which is suitable for directly or indirectly rotatably connecting the drill pipe and the drilling apparatus.

As a non-limiting example, the swivel may comprise a proximal swivel component and a distal swivel component. The proximal swivel component may be directly or indirectly non-rotatably connectable with the drill pipe. The distal swivel component may be directly or indirectly non-rotatably connectable with the drilling assembly. In some embodiments, the distal swivel component may be directly or indirectly non-rotatably connectable with the drilling assembly housing.

When the swivel is in the locked position, the proximal swivel component may be non-rotatably connected with the distal swivel component. When the swivel is in the unlocked position, the proximal swivel component may be rotatably connected with the distal swivel component.

The proximal swivel component may be directly or indirectly removably or permanently connectable with the drill string in any suitable manner, including as non-limiting examples, with a threaded connection, with an interference fit, or by welding. The distal swivel component may be directly or indirectly removably or permanently connectable with the drilling assembly housing in any suitable manner, including as non-limiting examples, with a threaded connection, with an interference fit, or by welding.

The swivel actuator may comprise any structure, device or apparatus which is suitable for selectively actuating the swivel between the locked position and the unlocked position. As non-limiting examples, the swivel actuator may comprise a mechanical, electrical, magnetic, hydraulic, and/or pneumatic actuator. As non-limiting examples, the swivel actuator may comprise a clutch mechanism, a magnetic coupling, and/or a locking mechanism.

In some embodiments, the swivel actuator may comprise a locking element for non-rotatably connecting the proximal swivel component with the distal swivel component when the swivel is in the locked position. The locking element may comprise a single locking element component or may comprise a plurality of locking element components.

In some embodiments, the locking element may be movable relative to at least one of the proximal swivel component and the distal swivel component to actuate the swivel between the locked position and the unlocked position. The locking element may be movable in any manner in order to actuate the swivel between the locked position and the unlocked position. As non-limiting examples, the locking element may be movable axially, radially, and/or rotationally in order to actuate the swivel between the locked position and the unlocked position.

The locking element may be non-rotatably connected with both the proximal swivel component and the distal swivel component when the swivel is in the locked position so that the proximal swivel component and the distal swivel component are non-rotatably connected with each other. In some embodiments, the locking element may be non-rotatably connected with one of the proximal swivel component and the distal swivel component when the swivel is in both the locked position and the unlocked position. In some embodiments, the locking element may be rotatably connected with both of the proximal swivel component and the distal swivel component when the swivel is in the unlocked position. In some embodiments, the locking element may be integral with one of the proximal swivel component and the distal swivel component so that the locking element is non-rotatably connected with the one of the swivel components when the swivel is in both the locked position and the unlocked position.

The locking element may comprise a locking element engagement surface and the swivel may comprise a swivel component engagement surface. The locking element engagement surface may be engaged with the swivel component engagement surface such that the proximal swivel component is non-rotatably connected with the distal swivel component when the swivel is in the locked position. The locking element engagement surface may be disengaged from the swivel component engagement surface such that the proximal swivel component is rotatably connected with the distal swivel component when the swivel is in the unlocked position.

The locking element engagement surface and the swivel component engagement surface may comprise, consist of, or consist essentially of any surface or surfaces which are capable of interacting to non-rotatably connect the proximal swivel component with the distal swivel component. As non-limiting examples, a locking element engagement surface and a swivel component engagement surface may comprise complementary splines, blades, cams, or gears.

In some particular embodiments, the locking element may be axially movable to actuate the swivel between the locked position and the unlocked position. In some particular embodiments, the locking element may be radially movable to actuate the swivel between the locked position and the unlocked position. In some particular embodiments, the locking element may be rotationally movable to actuate the swivel between the locked position and the unlocked position. In some particular embodiments, the locking element may be movable by a combination of axial, radial, and rotational movements to actuate the swivel between the locked position and the unlocked position.

The locking element may be positioned at any suitable location in the drilling apparatus. In some embodiments, the drilling apparatus may comprise an apparatus bore and the locking element may be positioned within the apparatus bore.

In some embodiments, the swivel actuator may comprise a mandrel. In some embodiments, the mandrel may be positioned within the apparatus bore. In some embodiments, the locking element may be movable by the mandrel to actuate the swivel between the locked position and the unlocked position. In some embodiments, the mandrel may define a mandrel bore for circulating a circulating fluid such as a drilling fluid through the drilling apparatus.

The mandrel may be movable within the apparatus bore in any manner which is capable of actuating the swivel between the locked position and the unlocked position. The locking element may be associated with the mandrel in any manner which enables the locking element to be moved by the mandrel to actuate the swivel between the locked position and the unlocked position. As non-limiting examples, the locking element may engage the mandrel, may be connected with the mandrel, or may be formed integrally with the mandrel.

In some embodiments, the mandrel may be axially movable within the apparatus bore and the locking element may be axially movable by the mandrel.

In some particular embodiments, the mandrel may be axially movable within the apparatus bore in response to circulating a circulating fluid such as a drilling fluid through the drilling apparatus. In such embodiments, the mandrel may be axially movable within the apparatus bore by applying a threshold actuating force to the mandrel by circulating the circulating fluid, wherein the threshold actuating force is the amount of net force acting on the mandrel which is required in order to axially move the mandrel.

A net force acting on the mandrel which results from circulating the circulating fluid through the drilling apparatus may be provided in any suitable manner, including as non-limiting examples, by blocking or constricting the flow of the circulating fluid through the drilling apparatus, by providing a pressure drop of a circulating fluid as it passes through the drilling apparatus, and/or by configuring the mandrel so that the circulating fluid exerts unbalanced opposing axial forces on the mandrel. As non-limiting examples, the mandrel may be configured so that the circulating fluid exerts unbalanced opposing axial forces on the mandrel by providing unequal opposing areas of the mandrel upon which the circulating fluid exerts a pressure and/or by providing unequal pressures of the circulating fluid which act on opposing surfaces of the mandrel. In some embodiments, the net force acting on the mandrel may be increased to the threshold actuating force by increasing the flowrate and/or the pressure of the circulating fluid passing through the drilling apparatus.

In some embodiments, the swivel actuator may comprise a mandrel biasing device for urging the mandrel toward either the proximal end or the distal end of the drilling apparatus. The mandrel biasing device may comprise, consist of, or consist essentially of any structure, device, or apparatus which is capable of exerting a biasing force on the mandrel. As a non-limiting example, the mandrel biasing device may comprise one or more springs positioned within the apparatus bore.

In some particular embodiments, the mandrel biasing device may urge the mandrel toward the proximal end of the drilling apparatus in order to oppose a force or forces acting on the mandrel which may tend to axially move the mandrel toward the distal end of the drilling apparatus. As a non-limiting example, the mandrel biasing device may be configured to offset unbalanced opposing axial forces acting on the mandrel during normal drilling conditions, and so that the biasing force provided by the mandrel biasing device can be overcome by applying the threshold actuating device to the mandrel.

The swivel may be in the locked position when the mandrel is in a first mandrel position, and the swivel may be in the unlocked position when the mandrel is in a second mandrel position. The first mandrel position may be an axial position, a radial position, and/or a rotational position. The second mandrel position may be an axial position, a radial position, and/or a rotational position. In some embodiments, the first mandrel position may be an axial first mandrel position. In some embodiments, the second mandrel position may be an axial second mandrel position.

In some embodiments, the swivel actuator may comprise an indexing mechanism for achieving, controlling and/or maintaining a mandrel position. The indexing mechanism may comprise, consist of, or consist essentially of any structure, device or apparatus which is capable of achieving, controlling and/or maintaining a mandrel position. As non-limiting examples, the indexing mechanism may comprise a linear actuator, a collet mechanism, a j-slot mechanism, and/or or a barrel cam assembly. The indexing mechanism may operate cooperatively with the mandrel biasing device in order to achieve, control and/or maintain a mandrel position.

As a non-limiting example, the indexing mechanism may comprise a barrel cam assembly comprising a barrel cam and a barrel cam pin. The barrel cam may be axially movable and rotatable relative to the barrel cam pin and may define a circumferential track for the barrel cam pin. The circumferential track may define two or more positions. In some embodiments, the circumferential track may define a first position corresponding to the axial first mandrel position and a second position corresponding to the axial second mandrel position. In some embodiments, the circumferential track may define a plurality of first positions and a plurality of second positions. In some embodiments, the plurality of first positions and the plurality of second positions may alternate along the circumferential track. In some embodiments, the circumferential track may define one or more positions in addition to the first position and the second position. In some embodiments, some or all of the additional positions of the circumferential track may correspond to one or more additional axial mandrel positions.

In some embodiments, the barrel cam assembly may be positioned within the apparatus bore. In some embodiments, the barrel cam or the barrel cam pin may be movable by the mandrel. In some particular embodiments, the barrel cam may be positioned within the apparatus bore and may be axially movable by the mandrel, and the barrel cam pin may be fixedly positioned within the apparatus bore. In some particular embodiments, the barrel cam pin may be positioned within the apparatus bore and may be axially movable by the mandrel, and the barrel cam may be rotatably positioned within the apparatus bore.

The rotation restraining device may comprise, consist of, or consist essentially of any structure, device or apparatus which is suitable for engaging a borehole in order to inhibit rotation of the drilling assembly housing relative to the borehole and which is capable of being actuatable between the retracted position and the extended position. In some embodiments, the rotation restraining device may be actuatable to one or more intermediate positions between the retracted position and the extended position. As non-limiting examples, the rotation restraining device may comprise blocks, blades, pads, expandable devices, and/or inflatable devices.

In some embodiments, the rotation restraining device may comprise at least one borehole engagement member. In some embodiments, the rotation restraining device may comprise a plurality of borehole engagement members. In some embodiments, a plurality of borehole engagement members may be arranged around a circumference of the rotation restraining device.

A borehole engagement member may comprise, consist of any structure, device or apparatus which is radially moveable in order to actuate the rotation restraining device between the retracted position and the extended position. As non-limiting examples, a borehole engagement member may comprise one or more blocks, blades, pads, pistons, or inflatable devices.

In the extended position, rotation of the drilling assembly housing relative to the borehole may be inhibited at least in part by contact between the at least one borehole engagement member and the borehole which results from radially moving the at least one borehole engagement member against the borehole wall.

A borehole engagement member may be radially moveable in any manner. As non-limiting examples, a borehole engagement member may be radially moveable mechanically, electrically, magnetically, hydraulically, and/or pneumatically in order to actuate the rotation restraining device between the retracted position and the extended position.

In some embodiments, a borehole engagement member may comprise at least one radial extension member. A radial extension member may extend the extended position of the rotation restraining device to accommodate varying and/or irregular borehole sizes. A radial extension member may be actuatable between a retracted extension position and an enhanced extension position. When the rotation restraining device is in the extended position, the radial extension member may assist the borehole engagement member in maintaining contact with the borehole wall. In addition, the radial extension member may assist in providing a constant force against the borehole wall which may assist in inhibiting rotation of the drilling assembly housing relative to the borehole wall.

A radial extension member may comprise any structure, device or apparatus which is capable of extending the extended position of the rotation restraining device. As non-limiting examples, a radial extension member may comprise a block, a blade, a pad, a piston, or an inflatable device. A borehole engagement member may be configured in any manner to comprise one or more radial extension members. In some embodiments, a radial extension member may be a component of a borehole engagement member and may be radially movable relative to the other components of the borehole engagement member in order to be actuated between the retracted extension position and the enhanced extension position.

A radial extension member may be actuatable between the retracted extension position and the enhanced extension position in any manner. As non-limiting examples, a radial extension member may be actuatable mechanically, electrically, magnetically, hydraulically, and/or pneumatically. A radial extension member may be actuatable between the retracted extension position and the enhanced extension position with the borehole engagement member or independently of the borehole engagement member.

In some embodiments, a radial extension member may be extendably biased toward the enhanced extension position. A radial extension member may be extendably biased in any manner. In some embodiments, a radial extension member may be extendably biased by an extension member biasing device. In some embodiments, the extension member biasing device may be selected to provide a desired force against the borehole wall when the rotation restraining device is in the extended position. An extension member biasing device may be integral with a radial extension member and/or with another component of a borehole engagement member or may be a separate component of a borehole engagement member. As non-limiting examples, an extension member biasing device may comprise a resilient portion of a borehole engagement member and/or a radial extension member, or the extension member biasing device may comprise one or more springs such as helical springs or leaf springs.

In some embodiments, a borehole engagement member may define one or more cavities for carrying one or more radial extension members and extension member biasing devices. In some embodiments, an extension member biasing device may be positioned within a cavity within a borehole engagement member in order to extendably bias a radial extension member toward the enhanced extension position.

The outer surface of a borehole engagement member may comprise a borehole engagement surface for contacting a borehole wall when the rotation restraining device is in the extended position. In some embodiments, the borehole engagement surface may comprise a textured surface for enhancing the engagement between the rotation restraining device and the borehole wall by increased friction and/or by penetration of the borehole wall. As non-limiting examples, the textured surface may comprise one or more edges, points, grooves, serrations or some other non-smooth surface. The borehole engagement surface may be integral with a borehole engagement member or a radial extension member, or may be provided as one or more engagement inserts which are mounted in the outer surface of the borehole engagement member. An engagement insert may comprise any shape, structure and material which is suitable for enhancing the engagement between the rotation restraining device and the borehole wall.

The rotation restraining device actuator may comprise any structure, device or apparatus which is suitable for selectively actuating the rotation restraining device between the retracted position and the extended position. As non-limiting examples, the rotation restraining device actuator may comprise a mechanical, electrical, magnetic, hydraulic, and/or pneumatic actuator.

In some embodiments, the rotation restraining device actuator may comprise a hydraulic actuator. In some embodiments, the hydraulic actuator may comprise a valve mechanism for selectively delivering one or more fluid actuating pressures to the rotation restraining device in order to actuate the rotation restraining device between the retracted position and the extended position. The fluid actuating pressure may be derived from a circulating fluid passing through the drilling apparatus, or the hydraulic actuator may comprise a separate actuating fluid such as an oil for providing the one or more fluid actuating pressures.

In some particular embodiments comprising a hydraulic actuator, the valve mechanism may be actuated between an open position and a closed position. When the valve mechanism is actuated to the open position, a first fluid actuating pressure may be delivered to the rotation restraining device in order to actuate the rotation restraining device to one of the retracted position or the extended position. When the valve mechanism is actuated to the closed position, a second fluid actuating pressure may be delivered to the rotation restraining device in order to actuate the rotation restraining device to the other of the retracted position or the extended position.

In some particular embodiments comprising a hydraulic actuator, the hydraulic actuator may comprise a valve mechanism and an actuation chamber in pressure communication with both the valve mechanism and a borehole engagement member. In some such embodiments, when the valve mechanism is actuated to the open position, a portion of a circulating fluid passing through the drilling apparatus may be redirected in order to deliver a first actuating fluid pressure to the actuation chamber so that the rotation restraining device is actuated to the extended position. When the valve mechanism is actuated to the closed position, the portion of the circulating fluid passing through the drilling apparatus is not redirected in order to deliver a second actuating fluid pressure to the actuation chamber so that the rotation restraining device is actuated to the retracted position. In such embodiments, the first actuating fluid pressure and the second actuating fluid pressure may be delivered to the actuation chamber either directly by configuring the actuation chamber to be in fluid communication with the valve mechanism via an actuation chamber port, or indirectly by configuring the actuation chamber to contain a separate actuating fluid which is in pressure communication with the valve mechanism via a pressure transfer device such as a diaphragm, piston and/or some other device which is capable of communicating the actuating pressures between the valve mechanism and the actuation chamber.

In some particular embodiments comprising a hydraulic actuator, the hydraulic actuator may comprise a single actuation chamber for all of the borehole engagement members in the rotation restraining device. In some particular embodiments comprising a hydraulic actuator, the hydraulic actuator may comprise a plurality of actuation chambers, wherein an actuation chamber may be associated with more than one borehole engagement member, or wherein a separate actuation chamber may be associated with each of the borehole engagement members.

In some particular embodiments comprising a hydraulic actuator, the hydraulic actuator may comprise one way valves between the valve mechanism and one or more of the actuation chambers to prevent unwanted depressurization of the actuation chamber and/or to isolate the actuation of the borehole engagement members.

In some embodiments, the rotation restraining device actuator may comprise a mechanical actuator. In some embodiments, the mechanical actuator may comprise an actuator mechanism for selectively actuating the rotation restraining device between the retracted position and the extended position. The actuator mechanism may comprise any structure, device or apparatus which is capable of actuating the rotation restraining device between the retracted position and the extended position. As non-limiting examples, the actuator mechanism may comprise, consist of, or consist essentially of a ramp, a wedge, a collet, or a cam.

In some particular embodiments comprising a mechanical actuator, the mechanical actuator may comprise an actuator mechanism, and the actuator mechanism may comprise a ramp comprising one or more inclined ramp surfaces. In such embodiments, the one or more inclined ramp surfaces and the rotation restraining device may be moved relative to each other in order to actuate the rotation restraining device between the retracted position and the extended position.

In some particular embodiments comprising a mechanical actuator, a ramp comprising one or more inclined ramp surfaces and the at least one borehole engagement member may be movable relative to each other in order to actuate the rotation restraining device between the retracted position and the extended position. In some such embodiments, the ramp and the at least one borehole engagement member may define complementary inclined surfaces which may be movable relative to each other in order to actuate the rotation restraining device between the retracted position and the extended position. In some embodiments, the at least one borehole engagement member may be radially movable by the ramp in order to actuate the rotation restraining device between the retracted position and the extended position.

In some embodiments, the ramp may be moved relative to the rotation restraining device in order to actuate the rotation restraining device between the retracted position and the extended position. The ramp may be movable relative to the rotation restraining device in any manner and/or in any direction in order to actuate the rotation restraining device between the retracted position and the extended position. As non-limiting examples, the ramp may be axially movable, radially movable, and/or rotationally movable relative to the rotation restraining device and/or relative to at least one borehole engagement member. In some embodiments, the ramp may be axially movable relative to the rotation restraining device in order to actuate the rotation restraining device between the retracted position and the extended position.

The ramp may be positioned at any suitable location in the drilling apparatus. In some embodiments, the ramp may be positioned within the apparatus bore.

In some embodiments, the rotation restraining device actuator may comprise a mandrel. In some embodiments, the mandrel may be positioned within the apparatus bore. In some embodiments, the ramp may be movable by the mandrel to actuate the rotation restraining device between the retracted position and the extended position. In some embodiments, the mandrel may define a mandrel bore for circulating a circulating fluid such as a drilling fluid through the drilling apparatus.

The mandrel may be movable within the apparatus bore in any manner which is capable of actuating the rotation restraining device between the retracted position and the extended position.

The mandrel may be movable within the apparatus bore in any manner which is capable of actuating the rotation restraining device between the retracted position and the extended position. The ramp may be associated with the mandrel in any manner which enables the ramp to be moved by the mandrel to actuate the rotation restraining device between the retracted position and the extended position. As non-limiting examples, the ramp may engage the mandrel, may be connected with the mandrel, or may be formed integrally with the mandrel.

In some embodiments, the mandrel may be axially movable within the apparatus bore and the locking element may be axially movable by the mandrel.

In some particular embodiments, the mandrel may be axially movable within the apparatus bore in response to circulating a circulating fluid such as a drilling fluid through the drilling apparatus. In such embodiments, the mandrel may be axially movable within the apparatus bore by applying a threshold actuating force to the mandrel by circulating the circulating fluid, wherein the threshold actuating force is the amount of net force acting on the mandrel which is required in order to axially move the mandrel.

A net force acting on the mandrel which results from circulating the circulating fluid through the drilling apparatus may be provided in any suitable manner, including as non-limiting examples, by blocking or constricting the flow of the circulating fluid through the drilling apparatus, by providing a pressure drop of a circulating fluid as it passes through the drilling apparatus, and/or by configuring the mandrel so that the circulating fluid exerts unbalanced opposing axial forces on the mandrel. As non-limiting examples, the mandrel may be configured so that the circulating fluid exerts unbalanced opposing axial forces on the mandrel by providing unequal opposing areas of the mandrel upon which the circulating fluid exerts a pressure and/or by providing unequal pressures of the circulating fluid which act on opposing surfaces of the mandrel. In some embodiments, the net force acting on the mandrel may be increased to the threshold actuating force by increasing the flowrate and/or the pressure of the circulating fluid passing through the drilling apparatus.

In some embodiments, the rotation restraining device actuator may comprise a mandrel biasing device for urging the mandrel toward either the proximal end or the distal end of the drilling apparatus. The mandrel biasing device may comprise, consist of, or consist essentially of any structure, device, or apparatus which is capable of exerting a biasing force on the mandrel. As a non-limiting example, the mandrel biasing device may comprise one or more springs positioned within the apparatus bore.

In some particular embodiments, the mandrel biasing device may urge the mandrel toward the proximal end of the drilling apparatus in order to oppose a force or forces acting on the mandrel which may tend to axially move the mandrel toward the distal end of the drilling apparatus. As a non-limiting example, the mandrel biasing device may be configured to offset unbalanced opposing axial forces acting on the mandrel during normal drilling conditions, and so that the biasing force provided by the mandrel biasing device can be overcome by applying the threshold actuating device to the mandrel.

The rotation restraining device may be in the retracted position when the mandrel is in a first mandrel position, and the rotation restraining device may be in the extended position when the mandrel is in a second mandrel position. The first mandrel position may be an axial position, a radial position, and/or a rotational position. The second mandrel position may be an axial position, a radial position, and/or a rotational position. In some embodiments, the first mandrel position may be an axial first mandrel position. In some embodiments, the second mandrel position may be an axial second mandrel position.

In some embodiments, the rotation restraining device actuator may comprise an indexing mechanism for achieving, controlling and/or maintaining a mandrel position. The indexing mechanism may comprise, consist of, or consist essentially of any structure, device or apparatus which is capable of achieving, controlling and/or maintaining a mandrel position. As non-limiting examples, the indexing mechanism may comprise a linear actuator, a collet mechanism, a j-slot mechanism, and/or or a barrel cam assembly. The indexing mechanism may operate cooperatively with the mandrel biasing device in order to achieve, control and/or maintain a mandrel position.

As a non-limiting example, the indexing mechanism may comprise a barrel cam assembly comprising a barrel cam and a barrel cam pin. The barrel cam may be axially movable and rotatable relative to the barrel cam pin and may define a circumferential track for the barrel cam pin. The circumferential track may define two or more positions. In some embodiments, the circumferential track may define a first position corresponding to the axial first mandrel position and a second position corresponding to the axial second mandrel position. In some embodiments, the circumferential track may define a plurality of first positions and a plurality of second positions. In some embodiments, the plurality of first positions and the plurality of second positions may alternate along the circumferential track. In some embodiments, the circumferential track may define one or more positions in addition to the first position and the second position. In some embodiments, some or all of the additional positions of the circumferential track may correspond to one or more additional axial mandrel positions. The additional axial mandrel positions may enable the rotation restraining device to be actuated to a plurality of extended positions in order to accommodate different borehole sizes during drilling.

In some embodiments, the barrel cam assembly may be positioned within the apparatus bore. In some embodiments, the barrel cam or the barrel cam pin may be movable by the mandrel. In some particular embodiments, the barrel cam may be positioned within the apparatus bore and may be axially movable by the mandrel, and the barrel cam pin may be fixedly positioned within the apparatus bore. In some particular embodiments, the barrel cam pin may be positioned within the apparatus bore and may be axially movable by the mandrel, and the barrel cam may be rotatably positioned within the apparatus bore.

In some embodiments, the rotation restraining device actuator and the swivel actuator may comprise a combined actuator. The combined actuator may comprise any structure, device or apparatus which is suitable for both actuating the rotation restraining device between the retracted position and the extended position and actuating the swivel between the locked position and the unlocked position.

In some embodiments, the combined actuator may combine some or all of the features of the swivel actuator and the rotation restraining device actuator as previously described.

As a first non-limiting example, the combined actuator may comprise a locking element for actuating the swivel between the locked position and the unlocked position. As a second non-limiting example, the combined actuator may comprise a ramp for radially moving the at least one borehole engagement member in order to actuate the rotation restraining device between the retracted position and the extended position. As a third non-limiting example, the combined actuator may comprise a mandrel which may be movable within the apparatus bore in order to actuate the rotation restraining device and the swivel. As a fourth non-limiting example, the combined actuator may comprise a mandrel biasing device for urging the mandrel toward the proximal end or the distal end of the drilling apparatus. As a fifth non-limiting example, the swivel may be in the locked position and the rotation restraining device may be in the retracted position when the mandrel is in a first mandrel position, and the swivel may be in the unlocked position and the rotation restraining device may be in the extended position when the mandrel is in a second mandrel position. In a sixth non-limiting example, the combined actuator may comprise an indexing mechanism for achieving, controlling and/or maintaining a mandrel position.

A combined actuator may be particularly suited for use in the drilling apparatus if the drilling assembly is not axially located between the swivel and the rotation restraining device. As a result, in some particular embodiments, the rotation restraining device actuator and the swivel actuator may comprise separate actuators if the drilling assembly is axially located between the swivel and the rotation restraining device, and the rotation restraining device actuator and the swivel actuator may comprise a combined actuator if the rotation restraining device is axially located between the swivel and the drilling assembly.

In some embodiments, the drilling apparatus may comprise a signaling device for indicating the actuation state of the rotation restraining device and/or the swivel. The signaling device may comprise, consist of, or consist essentially of any device which is capable of providing a signal in response to the actuation state or actuation states, and may provide any type of signal which may be detected by an operator of the drilling apparatus. As non-limiting examples, the signaling device may comprise a mechanical, electrical, magnetic, hydraulic, and/or pneumatic device.

In some embodiments, the signaling device may comprise a hydraulic signaling device. In some such embodiments, the hydraulic signaling device may provide a pressure signal to indicate the actuation state of the rotation restraining device and/or the swivel. In some such embodiments, the signaling device may comprise a variable choke device which provides a restriction of the flow of a circulating fluid circulating through the drilling apparatus which varies according to the actuation state of the rotation restraining device and/or the swivel. A change in the restriction of the flow results in a pressure variation which can provide a pressure signal. The pressure signal may be sensed in order to determine the actuation state of the rotation restraining device and/or the swivel.

In some embodiments, the variable choke device may comprise an orifice and a choke member, wherein the orifice and the choke member move relative to each other to provide a varying restriction of flow through the orifice. In some particular embodiments, an end of the mandrel may comprise one of the orifice and the choke member, and the other of the orifice and the choke member may be positioned proximate the end of the mandrel, such that movement of the mandrel results in a variation in the relative positions of the orifice and the choke member, and such that the flow of a circulating fluid through the mandrel bore is restricted by varying amounts depending upon the position of the mandrel.

In some embodiments, during use of the drilling apparatus, one or more components of the drilling apparatus may be immersed in a circulating fluid such as a drilling fluid which is circulating through the drilling apparatus and/or through the borehole. In some of these embodiments, such components of the drilling apparatus may be lubricated and/or cooled by the circulating fluid, and such components may be described as "mud-lubricated components".

In some embodiments, during use of the drilling apparatus, one or more components of the drilling apparatus may be isolated from a circulating fluid such as a drilling fluid which is circulating through the drilling apparatus and/or through the borehole. In some of these embodiments, the isolated components of the drilling apparatus may be immersed in a lubricating fluid. The lubricating fluid may comprise any fluid which is suitable for lubricating and/or cooling the isolated components. In some of these embodiments, the lubricating fluid may comprise a suitable oil. In these embodiments, the isolated components may be described as "oil-lubricated components".

In some embodiments in which the drilling apparatus comprises isolated components, the drilling apparatus may define one or more lubricating fluid compartments for containing a lubricating fluid in order to immerse the isolated components and isolate the isolated components from a circulating fluid such as a drilling fluid which is circulating through the drilling apparatus and/or through the borehole. In some of these embodiments, the one or more lubricating fluid compartments may contain a suitable oil, and such lubricating fluid compartments may be described as "oil compartments".

In some embodiments, the drilling apparatus may comprise one or more seals for defining the one or more lubricating fluid compartments. The one or more seals may comprise, consist of, or consist essentially of any structure, device, or apparatus which is suitable for defining the one or more lubricating fluid compartments. As non-limiting examples, the one or more seals may comprise seals or seal assemblies which are suitable for use as stationary seals, rotary seals, and/or reciprocating seals.

In some embodiments, the drilling apparatus may comprise one or more pressure balancing systems for balancing, during use of the drilling apparatus, the pressures of lubricating fluids within the one or more lubricating fluid compartments with the pressures of a circulating fluid which is circulating through the drilling apparatus and/or through the borehole. The one or more pressure balancing systems may comprise, consist of, or consist essentially of any structure, device, or apparatus which is suitable for balancing pressures. As non-limiting examples, the one or more pressure balancing systems may comprise, consist of, or consist essentially of a diaphragm, a balance piston and/or some other device which is capable of communicating pressure between the circulating fluid and the lubricating fluid.

This description also relates to a method of drilling. The method of drilling may be performed using an apparatus such as the drilling apparatus described herein or the method may be performed using any other apparatus or combination of apparatus which is suitable for performing the method.

The method may comprise non-directional drilling and/or the method may comprise directional drilling.

In some embodiments, the method may comprise connecting a drilling assembly comprising a drilling assembly housing with a drill pipe, drilling while rotating the drill pipe and thereby rotating the drilling assembly housing, and/or drilling while rotating the drill pipe relative to the drilling assembly housing.

In some embodiments, drilling while rotating the drill pipe and thereby rotating the drilling assembly housing may be used to perform non-directional drilling of the borehole. In some embodiments, drilling while rotating the drill pipe relative to the drilling assembly housing may be used to perform non-directional drilling and/or to perform directional drilling of the borehole. In some embodiments, directional drilling while rotating the drill pipe relative to the drilling assembly housing may be performed using a drilling assembly comprising a directional drilling assembly. In some embodiments, the directional drilling assembly may comprise a steerable drilling motor.

In a particular non-limiting aspect, the method may be for drilling a borehole, and may comprise:

- connecting a drilling assembly with a drill pipe, wherein the drilling assembly comprises a drilling assembly housing;
- drilling while rotating the drill pipe and thereby rotating the drilling assembly housing; and
- drilling while rotating the drill pipe relative to the drilling assembly housing.

The method may be performed in any order. In some embodiments, the drilling while rotating the drill pipe and thereby rotating the drilling assembly housing may precede the drilling while rotating the drill pipe relative to the drilling assembly housing. In some embodiments, the drilling while rotating the drill pipe relative to the drilling assembly housing may precede the drilling while rotating the drill pipe and thereby rotating the drilling assembly housing. The method may comprise performing the drilling while rotating the drill pipe and thereby rotating the drilling assembly housing for a single period or for a plurality of periods. The method may comprise performing the drilling while rotating the drill pipe relative to the drilling assembly housing for a single period or for a plurality of periods. Periods of the drilling while rotating the drill pipe and thereby rotating the drilling assembly housing and periods of the drilling while rotating the drill pipe relative to the drilling assembly housing may be alternated or may be performed in any other order.

The method may be performed using a drill string comprising the drill pipe. In some embodiments, the method may be performed using a drilling apparatus comprising a rotation restraining device, a swivel, and a drilling assembly. The drill string may comprise the drilling apparatus. In some embodiments, the method may be performed using a drilling apparatus as previously described herein. In some embodiments, the method may be performed using a drilling assembly comprising a directional drilling assembly.

The rotation restraining device may be actuatable between a retracted position and an extended position. The rotation restraining device may be connected with the drilling assembly housing such that rotation of the drilling assembly housing relative to the borehole is inhibited when the drilling apparatus is in the borehole and the rotation restraining device is in the extended position.

The swivel may be actuatable between a locked position and an unlocked position. The drilling assembly housing may be rotatable with the drill pipe when the swivel is in the locked position. The drill pipe may be rotatable relative to the drilling assembly housing when the swivel is in the unlocked position.

In some embodiments, actuating the rotation restraining device may be performed using a rotation restraining device actuator. In some embodiments, the rotation restraining device actuator may comprise a mandrel. In some embodiments, actuating the rotation restraining device may comprise moving the mandrel. In some embodiments, the mandrel may be moved in response to a threshold actuating force acting on the mandrel. In some embodiments, the threshold actuating force may be provided by circulating a circulating fluid through the drilling apparatus.

In some particular embodiments, the rotation restraining device actuator may comprise a ramp. In some such embodiments, actuating the rotation restraining device may comprise moving the ramp by moving the mandrel. In some such embodiments, actuating the rotation restraining device may comprise axially moving the ramp by moving the mandrel. In some such embodiments, actuating the rotation restraining device may comprise axially moving the ramp by axially moving the mandrel.

In some particular embodiments, the rotation restraining device actuator may comprise a valve mechanism. In some such embodiments, actuating the rotation restraining device may comprise actuating the valve mechanism between an open position and a closed position by moving the mandrel. In some such embodiments, actuating the rotation restraining device may comprise actuating the valve mechanism between an open position and a closed position by axially moving the mandrel.

In some embodiments, actuating the swivel may be performed using a swivel actuator. In some embodiments, the swivel actuator may comprise a locking element. In some embodiments, the swivel actuator may comprise a mandrel. In some embodiments, actuating the swivel may comprise moving the mandrel. In some embodiments, actuating the swivel may comprise moving the locking element by moving the mandrel. In some embodiments, actuating the swivel may comprise axially moving the locking element by moving the mandrel. In some embodiments, actuating the swivel may comprise axially moving the locking element by axially moving the mandrel. In some embodiments, the mandrel may be moved in response to a threshold actuating force acting on the mandrel. In some embodiments, the threshold actuating force may be provided by circulating a circulating fluid through the drilling apparatus.

In some embodiments, actuating the rotation restraining device and actuating the swivel may be performed using a combined actuator. In some embodiments, the combined actuator may comprise a mandrel. In some embodiments, actuating the rotation restraining device and actuating the swivel may comprise moving the mandrel. In some embodiments, the combined actuator may comprise a ramp and actuating the rotation restraining device may comprise moving the ramp by moving the mandrel. In some embodiments, the combined actuator may comprise a valve mechanism and actuating the rotation restraining device may comprise actuating the valve mechanism between an open position and a closed position by moving the mandrel. In some embodiments, the combined actuator may comprise a locking element and actuating the swivel may comprise moving the locking element by moving the mandrel. In some embodiments, the combined actuator may actuate the rotation restraining device to the retracted position when actuating the swivel to the locked position. In some embodiments the combined actuator may actuate the rotation restraining device to the extended position when actuating the swivel to the unlocked position.

During the drilling while rotating the drill pipe and thereby rotating the drilling assembly housing, the rotation restraining device may be actuated to the retracted position and the swivel may be actuated to the locked position. During the drilling while rotating the drill pipe relative to the drilling assembly housing, the rotation restraining device may be actuated to the extended position and the swivel may be actuated to the unlocked position.

In some embodiments, actuating the rotation restraining device to the retracted position and actuating the swivel to the locked position may be performed before commencing a period of the drilling while rotating the drill pipe and thereby rotating the drilling assembly housing and/or after ending a period of the drilling while rotating the drill pipe relative to the drilling assembly housing. In some embodiments, actuating the rotation restraining device to the extended position and actuating the swivel to the unlocked position may be performed before commencing a period of the drilling while rotating the drill pipe and thereby rotating the drilling assembly housing and/or after ending a period of the drilling while rotating the drill pipe relative to the drilling assembly housing. In some embodiments, actuating the rotation restraining device between the retracted position and the extended position may be performed while the drill pipe is not rotating or while the drill pipe is rotating at a speed at which the actuation can be performed without damaging the drilling apparatus. In some embodiments, actuating the swivel between the locked position and the unlocked position may be performed while the drill pipe is not rotating or while the drill pipe is rotating at a speed at which the actuation can be performed without damaging the drilling apparatus.

Actuating the rotation restraining device between the retracted position and the extended position and actuating the swivel between the locked position and the locked position may be performed simultaneously or may be performed consecutively in any order.

The method may comprise non-directional drilling and/or the method may comprise directional drilling. The directional drilling may be performed using a drilling assembly comprising a directional drilling assembly. The directional drilling using a drilling assembly comprising a directional drilling assembly may be performed by drilling while rotating the drill pipe relative to the drilling assembly housing.

During the non-directional drilling using a drilling assembly comprising a directional drilling assembly, the rotation restraining device may be actuated to the retracted position and the swivel may be actuated to the locked position. During the directional drilling using a drilling assembly comprising a directional drilling assembly, the rotation restraining device may be actuated to the extended position and the swivel may be actuated to the unlocked position.

In some embodiments performing the method using a drilling assembly comprising a directional drilling assembly, the method may comprise repeating the non-directional drilling and/or the directional drilling as required in order to drill the borehole in a desired direction.

In some embodiments, actuating the rotation restraining device to the retracted position and actuating the swivel to the locked position may be performed before commencing a period of the non-directional drilling and/or after ending a period of the directional drilling. In some embodiments, actuating the rotation restraining device to the extended position and actuating the swivel to the unlocked position may be performed before commencing a period of the directional drilling and/or after ending a period of the non-directional drilling. In some embodiments, actuating the rotation restraining device between the retracted position and the extended position may be performed while the drill pipe is not rotating or while the drill pipe is rotating at a speed at which the actuation can be performed without damaging the drilling apparatus. In some embodiments, actuating the swivel between the locked position and the unlocked position may be performed while the drill pipe is not rotating or while the drill pipe is rotating at a speed at which the actuation can be performed without damaging the drilling apparatus.

BRIEF DESCRIPTION OF DRAWINGS

Embodiments of the invention will now be described with reference to the accompanying drawings, in which:

FIGS. 5A and 5B are views of the locking element in the swivel actuator depicted in FIGS. 3A-3F, wherein FIG. 5A is a side view of the locking element and FIG. 5B is a transverse section view of the locking element taken along line 5B-5B in FIG. 5A;

FIGS. 6A and 6B are views of the barrel cam in the indexing mechanism depicted in FIGS. 3A-3F, wherein FIG. 6A is a pictorial view of the barrel cam and FIG. 6B is a side view of the barrel cam;

FIGS. 9A and 9B are schematic longitudinal section assembly views of the valve mechanism in the rotation restraining device actuator depicted in FIG. 8, wherein FIG. 9A depicts the valve in an open position, and FIG. 9B depicts the valve in a closed position;

DETAILED DESCRIPTION

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

FIGS. 1-15 depict non-limiting examples of a drill string, a drilling apparatus and components of a drilling apparatus.

FIGS. 1-15 are exemplary only. The features of the drilling apparatus and the components of the drilling apparatus depicted in FIGS. 1-15 and described herein may be included in alternative designs and types of drilling apparatus.

In the description of the exemplary embodiments which follows, features which are identical or generally equivalent in the exemplary embodiments may be identified with the same reference numbers.

Figure 1:
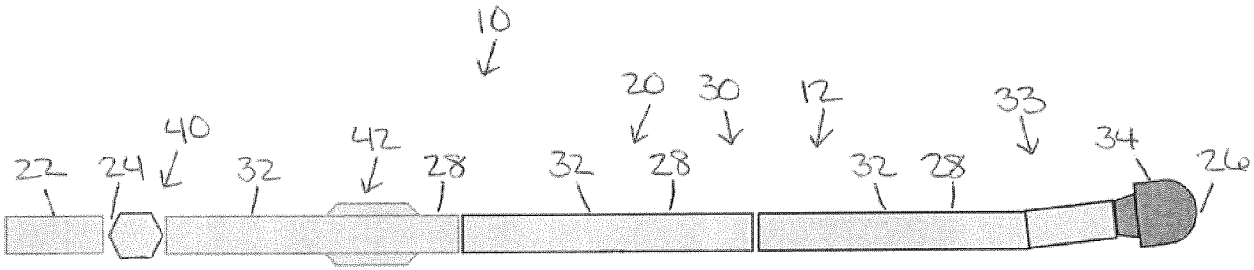
FIG. 1 is a schematic view of components of an exemplary drill string, including a drill pipe, a bottom-hole assembly comprising a drilling apparatus and a drilling assembly, and a drill bit.

Referring to FIG. 1, an exemplary drill string (10) includes a drill pipe (22), a bottom-hole assembly (12) comprising a drilling apparatus (20) and a drilling assembly (30), and a drill bit (34).

The drilling apparatus (20) comprises a proximal end (24), a distal end (26), and a drilling apparatus housing (28). As depicted in FIG. 1, the drilling apparatus (20) comprises the drilling assembly (30). In other embodiments, the drilling assembly (30) may be a component of the drill string (10) and/or the bottom-hole assembly (12) which is separate from the drilling apparatus (20).

The drilling assembly (30) comprises a drilling assembly housing (32). As depicted in FIG. 1, the drilling assembly housing (32) is a component of the drilling apparatus housing (28).

As depicted in FIG. 1, the drilling assembly (30) is a directional drilling assembly comprising a steerable drilling motor such as a steerable progressing cavity motor (PDM). As depicted in FIG. 1, the steerable drilling motor comprises an external bend (33) in the drilling assembly housing (32) which defines a toolface direction for the drilling assembly (30). In other embodiments, the steerable drilling motor may define a toolface direction in some other manner.

In other embodiments, the drilling assembly (30) may comprise a different type of drilling motor, may comprise a different type of directional drilling assembly, may comprise a non-directional drilling assembly, and/or may comprise some other type of suitable apparatus for providing drilling energy to the drill bit (34).

As depicted in FIG. 1, the drill bit (34) is connected with or otherwise positioned at the distal end (26) of the drilling apparatus (20).

The drilling apparatus (20) further comprises a swivel (40) and a rotation restraining device (42). As depicted in FIG. 1, the drilling assembly (30) and the rotation restraining device (42) are both axially located between the swivel (40) and the distal end (26) of the drilling apparatus (20). As depicted in FIG. 1, the rotation restraining device (42) is also axially located between the swivel (40) and the drilling assembly (30). In other embodiments, the drilling assembly (30) may be axially located between the swivel (40) and the rotation restraining device (42).

The swivel (40) is actuatable between a locked position and an unlocked position. In the locked position, the drilling assembly housing (32) is rotatable with the drill pipe (22). In the unlocked position, the drill pipe (22) is rotatable relative to the drilling assembly housing (32). The drilling apparatus (20) further comprises a swivel actuator (not specifically shown in FIG. 1) for actuating the swivel (40) between the locked position and the unlocked position.

The rotation restraining device (42) is actuatable between a retracted position and an extended position. The rotation restraining device (42) is connected directly or indirectly with the drilling assembly housing (32) such that rotation of the drilling assembly housing (32) relative to the borehole is inhibited when the drilling apparatus (20) is in the borehole and the rotation restraining device (42) is in the extended position. The drilling apparatus (20) further comprises a rotation restraining device actuator (not specifically shown in FIG. 1) for actuating the rotation restraining device (42) between the retracted position and the extended position.

Referring to FIGS. 2-15, features of exemplary embodiments of the drilling apparatus (20) and/or its components are described in further detail. In the exemplary embodiments, the drilling apparatus (20) may be included as one or more components of a bottom-hole assembly (12) in a drill string (10) of the type depicted in FIG. 1.

In the exemplary embodiments which are described in connection with FIGS. 2-15, the drilling apparatus (20) may further comprise a drilling assembly such as the drilling assembly (30) which is depicted in FIG. 1, but which is not depicted in FIGS. 2-15. Alternatively, the drilling assembly may be a component of the drill string (10) and/or the bottom-hole assembly (12) which is separate from the drilling apparatus (20).

In the exemplary embodiments, the drilling apparatus (20) comprises the drilling apparatus housing (28), and the drilling assembly (30) comprises the drilling assembly housing (32). In the exemplary embodiments, the drilling assembly housing (32) may be a component of the drilling apparatus housing (28).

Referring to FIGS. 2-6, an exemplary embodiment of the drilling apparatus (20) is depicted. The drilling apparatus (20) comprises the swivel (40) and the rotation restraining device (42). Referring to FIGS. 3A-3F, the drilling apparatus (20) further comprises a swivel actuator (44) and a rotation restraining device actuator (46).

Figure 2:
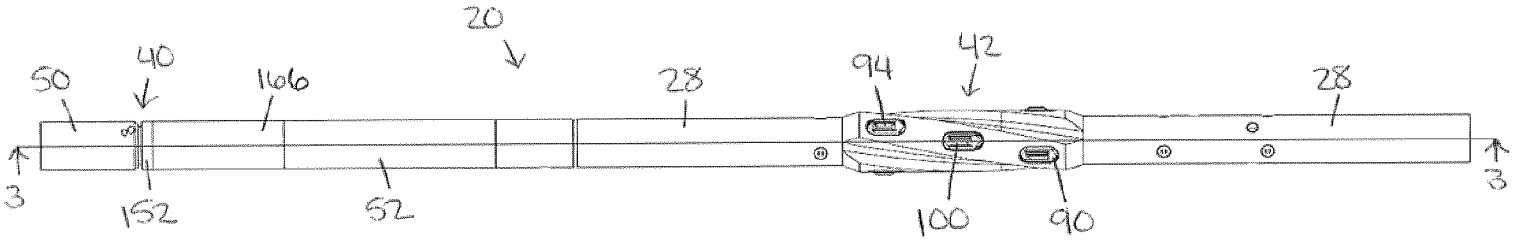
FIG. 2 is a side view of components of an exemplary embodiment of a drilling apparatus for use in a drill string of the type depicted in FIG. 1, wherein the depicted components include a rotation restraining device, a rotation restraining device actuator, a swivel, and a swivel actuator.
Figure 3A:
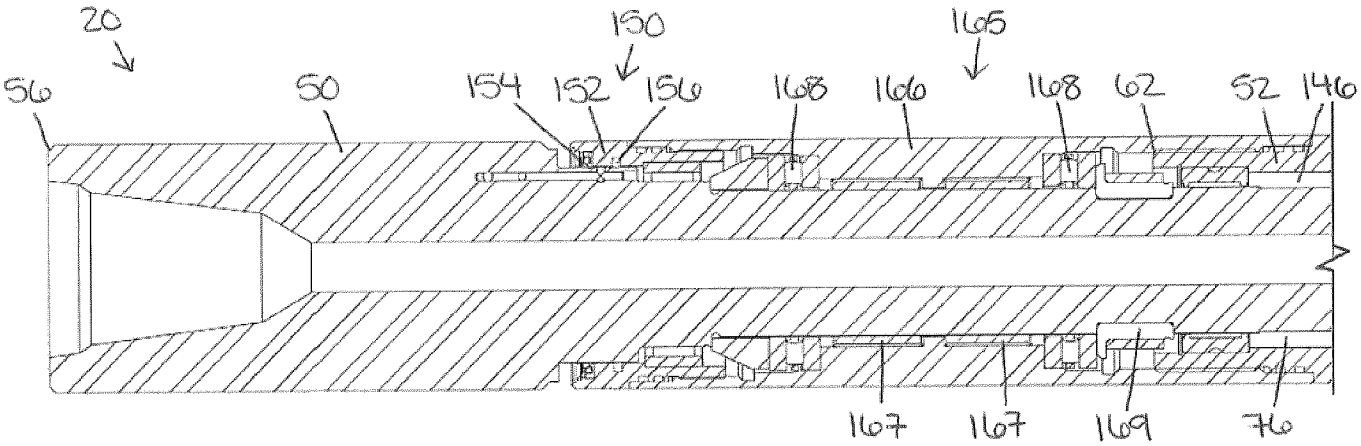
FIGS. 3A-3F are longitudinal section assembly views of components of the exemplary embodiment of the drilling apparatus depicted in FIG. 2, taken along line 3-3 in FIG. 2.
Figure 3B:
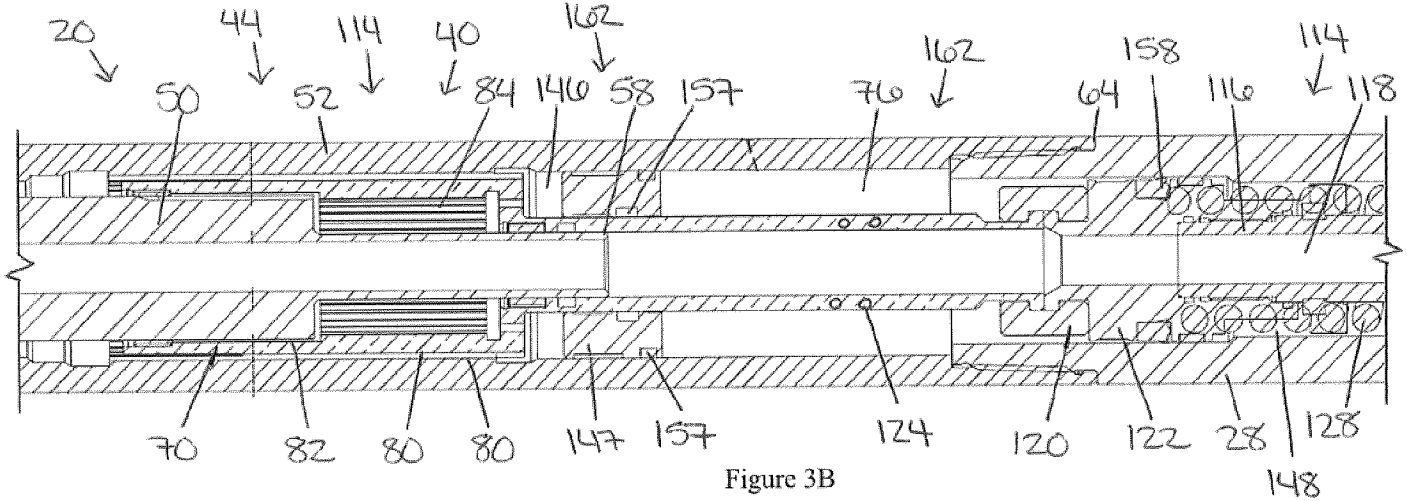
Figure 3C:
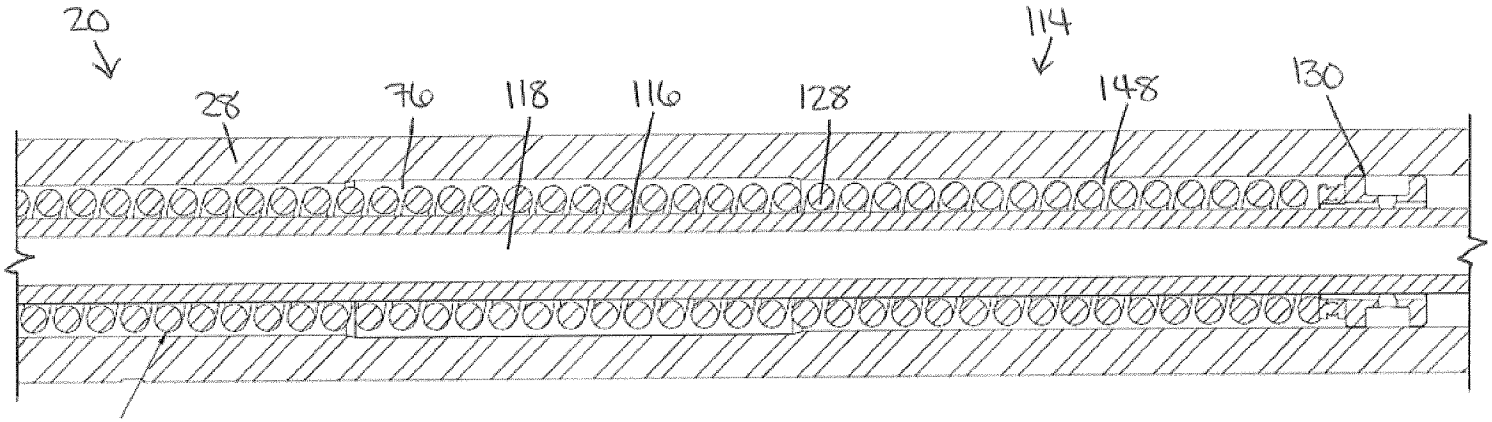
Figure 3D:
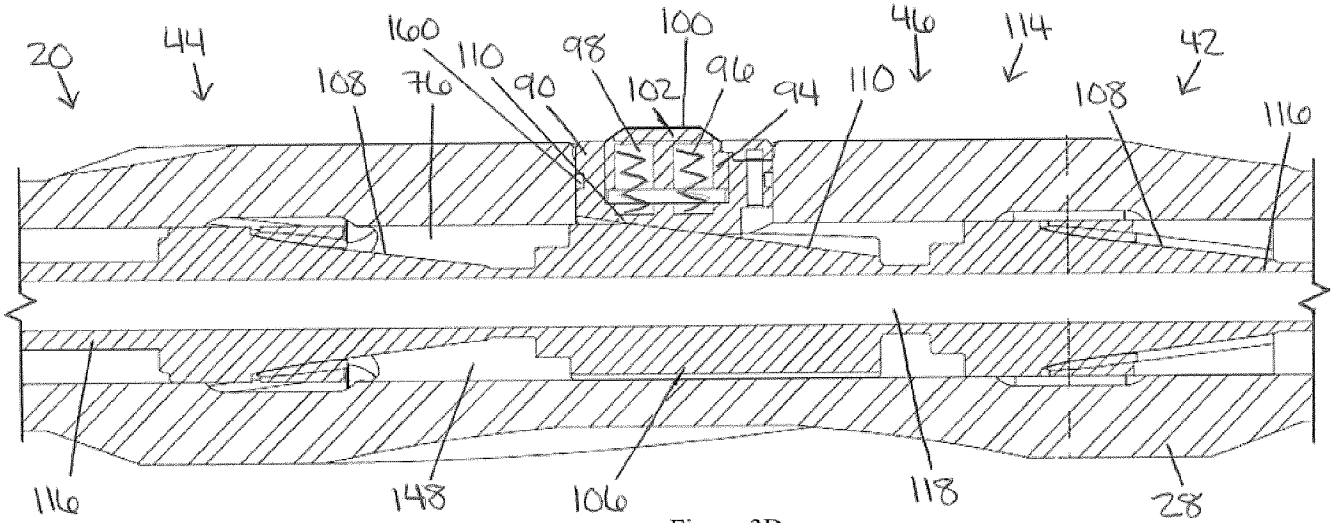
Figure 3E:
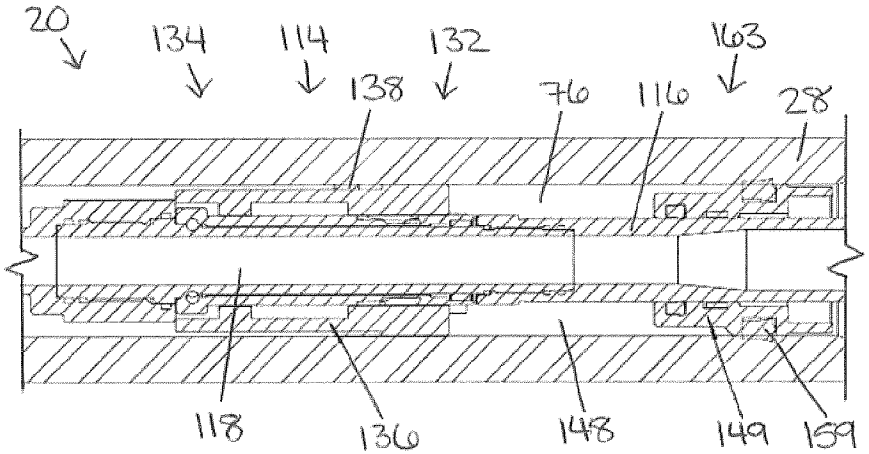

As depicted in FIGS. 2, 3A, and 3B, in the exemplary embodiment of the drilling apparatus (20), the swivel (40) comprises a proximal swivel component (50) and a distal swivel component (52). FIG. 4 depicts the proximal swivel component (50) in isolation. When the swivel (40) is in the locked position, the proximal swivel component (50) is non-rotatably connected with the distal swivel component (52). When the swivel (40) is in the unlocked position, the proximal swivel component (50) is rotatable relative to the distal swivel component (52). FIGS. 3A-3F depict the swivel (40) in the unlocked position.

The proximal swivel component (50) comprises a proximal end (56) and a distal end (58). In the exemplary embodiment of the drilling apparatus (20), the proximal end (56) of the proximal swivel component (50) is non-rotatably connectable directly or indirectly with the drill pipe (22).

The distal swivel component (52) comprises a proximal end (62) and a distal end (64). In the exemplary embodiment of the drilling apparatus (20), the distal end (64) of the distal swivel component (52) is non-rotatably connected or connectable directly or indirectly with additional components of the drilling apparatus (20), including the drilling assembly housing (32).

Figure 5B:
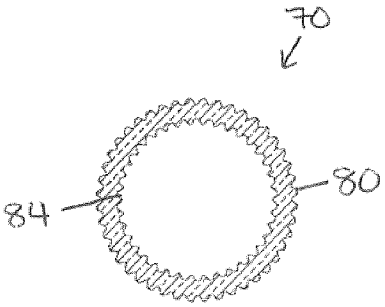
Figure 5A:
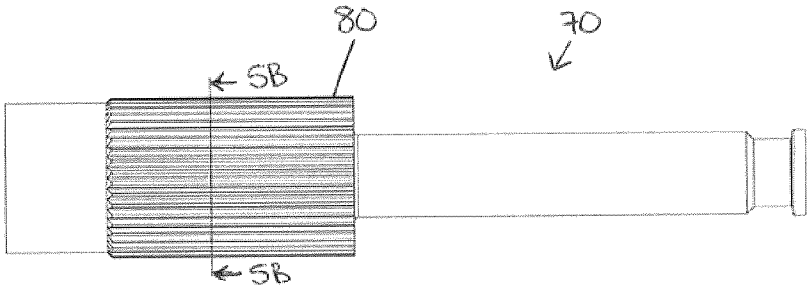

Referring to FIG. 3B, the swivel actuator (44) comprises a locking element (70) for non-rotatably connecting the proximal swivel component (50) with the distal swivel component (52) when the swivel (40) is in the locked position. FIGS. 5A and 5B depict the locking element (74) in isolation.

The drilling apparatus (20) defines an apparatus bore (76). In the exemplary embodiment of the drilling apparatus (20), the locking element (70) is positioned within the apparatus bore (76) and is axially movable within the apparatus bore (76) relative to both the proximal swivel component (50) and the distal swivel component (52) in order to actuate the swivel (40) between the locked position and the unlocked position.

In the exemplary embodiment of the drilling apparatus (20), the locking element (70) is non-rotatably coupled with the distal swivel component (52) by complementary coupling surfaces (80) comprising splines when the swivel (40) is in both the locked position and the unlocked position. The complementary coupling surfaces (80) allow axial movement of the locking element (70) relative to the distal swivel component (52) while preventing rotation of the locking element (70) relative to the distal swivel component (52).

In the exemplary embodiment of the drilling apparatus (20), the proximal swivel component (50) comprises a swivel component engagement surface (82) and the locking element (70) comprises a locking element engagement surface (84) for non-rotatably connecting the proximal swivel component (50) with the locking element (70) when the swivel (40) is in the locked position. In the exemplary embodiment of the drilling apparatus (20), the swivel component engagement surface (82) and the locking element engagement surface (84) comprise complementary splines.

When the swivel (40) is in the locked position, the swivel component engagement surface (82) is engaged with the locking element engagement surface (84) so that the proximal swivel component (50) is non-rotatably connected with the locking element (70). When the swivel (40) is in the unlocked position as shown in FIG. 3B, the swivel component engagement surface (82) is disengaged from the locking element engagement surface (84) so that the proximal swivel component (50) is rotatable relative to the locking element (70). As a result, in the exemplary embodiment of the drilling apparatus (20), when the swivel (40) is in the locked position the locking element (70) is non-rotatably connected with both the proximal swivel component (50) and the distal swivel component (52), so that the proximal swivel component (50) is non-rotatably connected with the distal swivel component (52).

The swivel actuator (44) may further comprise additional components for axially moving the locking element (70) within the apparatus bore (76). In the exemplary embodiment of the drilling apparatus (20), the swivel actuator (44) further comprises a mandrel (116). In the exemplary embodiment of the drilling apparatus (20), the mandrel (116) is positioned within the apparatus bore (76) and is axially movable within the apparatus bore (76). In the exemplary embodiment of the drilling apparatus (20), the mandrel (116) comprises a mandrel bore (118) so that a circulating fluid can pass through the drilling apparatus (20) via the mandrel bore (118).

In the exemplary embodiment of the drilling apparatus (20), the locking element (70) is axially movable by the mandrel (116) to actuate the swivel (40) between the locked position and the unlocked position. In the exemplary embodiment of the drilling apparatus (20), the locking element (70) is connected with the mandrel (116) by a coupler (120) so that axial movement of the mandrel (116) causes axial movement of the locking element (70).

In the exemplary embodiment of the drilling apparatus (20), the swivel (40) is in the locked position when the mandrel (116) is in an axial first mandrel position, and the swivel (40) is in the unlocked position when the mandrel (116) is in an axial second mandrel position. The mandrel (116) is axially positioned relatively toward the proximal end (24) of the drilling apparatus (20) when the mandrel (116) is in the axial first mandrel position. The mandrel (116) is axially positioned relatively toward the distal end (26) of the drilling apparatus (20) when the mandrel (116) is in the axial second mandrel position. FIGS. 3A-3F depict the mandrel (116) in the axial second mandrel position.

In the exemplary embodiment of the drilling apparatus (20), the mandrel (116) is axially movable within the apparatus bore (76) in response to a threshold actuating force acting on the mandrel (116). More particularly, in the exemplary embodiment of the drilling apparatus (20), the mandrel (116) is axially movable within the apparatus bore (76) in response to a threshold actuating force acting on the mandrel (116) which results from circulating a circulating fluid such as a drilling fluid (not shown) through the drilling apparatus (20) via the mandrel bore (118) and the apparatus bore (76). The threshold actuating force may be achieved by increasing the flowrate and/or the pressure of the circulating fluid passing through the drilling apparatus.

Figure 3F:
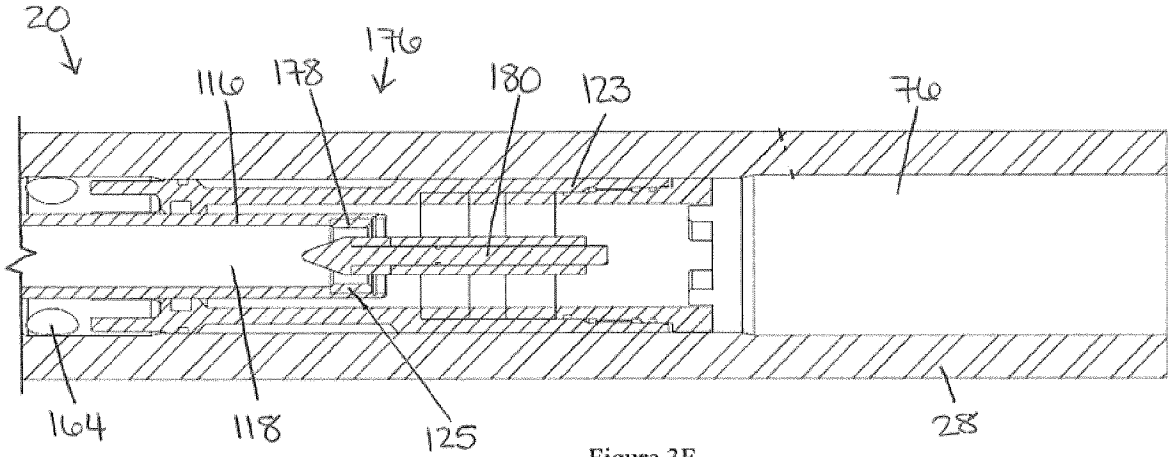
Figure 4:
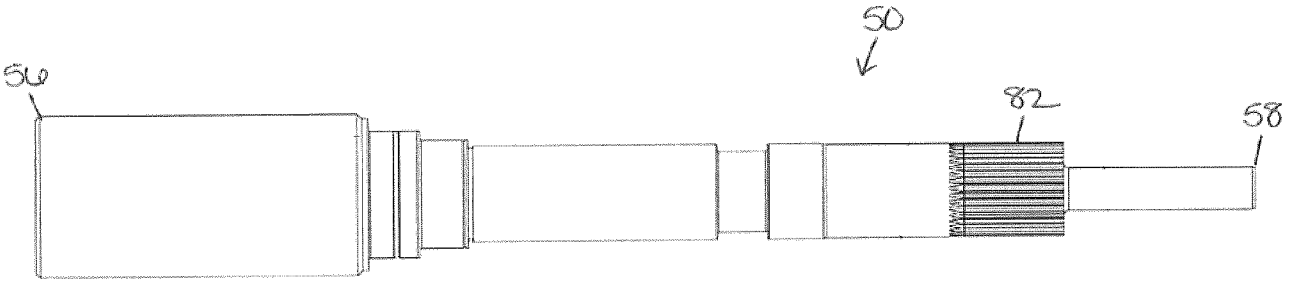
FIG. 4 is a side view of the proximal swivel component in the swivel depicted in FIGS. 3A-3F.

In this regard, referring to FIGS. 3B and 3F, in the exemplary embodiment of the drilling apparatus (20), the mandrel (116) comprises an upper mandrel piston (122) and a lower mandrel piston (123).

Referring to FIGS. 3B and 3F, in the exemplary embodiment of the drilling apparatus (20), the effective cross-sectional area of the upper mandrel piston (122) is greater than the effective cross-sectional area of the lower mandrel piston (123) so that an equal pressure exerted on the upper mandrel piston (122) and the lower mandrel piston (123) will result in a greater axial force being exerted on the upper mandrel piston (122) than on the lower mandrel piston (123), thereby urging the mandrel toward the axial second mandrel position.

Referring to FIG. 3B, in the exemplary embodiment of the drilling apparatus (20), the mandrel (116) defines a plurality of mandrel ports (124) adjacent to the upper mandrel piston (122) for providing pressure communication between the interior of the mandrel bore (118) and the exterior of the mandrel bore (118) so that the upper mandrel piston (122) is exposed to the pressure of the circulating fluid within the mandrel bore (118).

Referring to FIG. 3F, in the exemplary embodiment of the drilling apparatus (20), the lower mandrel piston (123) comprises a bitjet (125) which is positioned within the mandrel bore (118) and creates a pressure drop adjacent to the lower mandrel piston (123). Because of the configuration of the mandrel pistons (122, 123), the presence of the mandrel ports (124) adjacent to the upper mandrel piston (122), and the presence of the bitjet (125) at the lower mandrel piston (123), the net force acting on the mandrel (116) which results from circulating a circulating fluid through the drilling apparatus (20) will tend to urge the mandrel (116) toward the distal end (26) of the drilling apparatus (20) and toward the axial second mandrel position.

As depicted in FIGS. 3B-3C, in the exemplary embodiment of the drilling apparatus (20), the swivel actuator (44) further comprises a mandrel biasing device (128) for urging the mandrel (116) toward the proximal end (24) of the drilling apparatus (20) and toward the axial first mandrel position. In the exemplary embodiment of the drilling apparatus, the mandrel biasing device (128) is configured so that the biasing force provided by the mandrel biasing device (128) offsets the net force acting on the mandrel (116) which results from circulating a circulating fluid through the drilling apparatus (20) under normal drilling conditions, and so that the biasing force provided by the mandrel biasing device (128) can be overcome by increasing the flowrate and/or the pressure of the circulating fluid passing through the drilling apparatus (20) in order to increase the net force acting on the mandrel (116) to the threshold actuating force.

In the exemplary embodiment of the drilling apparatus (20), the mandrel biasing device (128) comprises a spring positioned within the apparatus bore (76). In the exemplary embodiment of the drilling apparatus (20), the swivel actuator (44) further comprises a stop (130) which is fixedly mounted on the drilling apparatus housing (28) and projects within the apparatus bore (76). One end of the spring engages the stop (130) and the other end of the spring engages the mandrel (116) in order to urge the mandrel (116) toward the proximal end (24) of the drilling apparatus (20) and toward the axial first mandrel position.

In the exemplary embodiment of the drilling apparatus (20), the swivel actuator (44) comprises an indexing mechanism (132) for achieving, maintaining, and/or controlling the desired axial positions of the mandrel (116). More particularly, in the exemplary embodiment of the drilling apparatus (20), the indexing mechanism (132) assists in enabling the mandrel (116) to achieve and maintain the axial first mandrel position and the axial second mandrel position.

In the exemplary embodiment of the drilling apparatus (20), the indexing mechanism (132) comprises a barrel cam assembly (134) positioned within the apparatus bore (76).

Figure 6A:
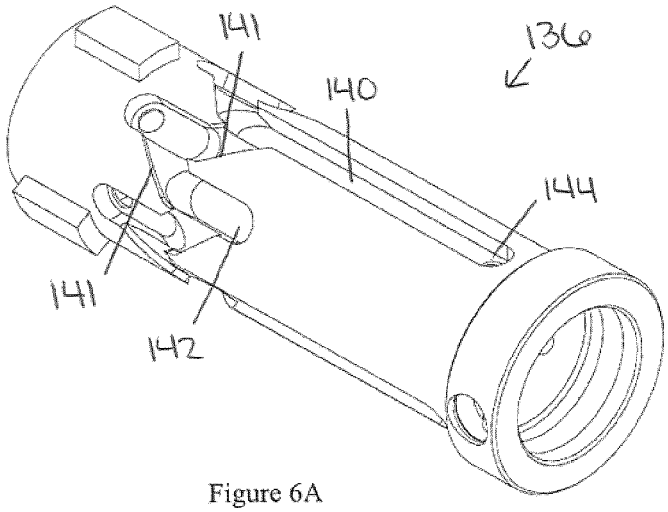
Figure 6B:
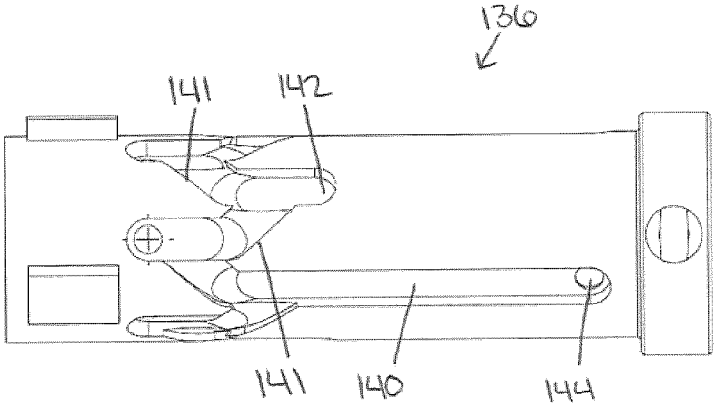

The barrel cam assembly (134) comprises a barrel cam (136) and a barrel cam pin (138). FIGS. 6A and 6B depict the barrel cam (136) in isolation.

Referring to FIGS. 3E, 6A, and 6B, the barrel cam (136) is rotatably mounted on the mandrel (116). The barrel cam pin (138) is fixedly mounted on the drilling apparatus housing (28) and projects within the apparatus bore (76). The barrel cam (136) defines a circumferential track (140) for the barrel cam pin (138). The barrel cam (136) is axially movable by the mandrel (116) and rotatable relative to the mandrel (116) so that the barrel cam pin (138) can follow the circumferential track (140) as the barrel cam (136) moves axially and rotates relative to the barrel cam pin (138).

As depicted in FIG. 6A, the circumferential track (140) includes steps (141) which force the barrel cam pin (138) to move in a single direction along the circumferential track (140). In the exemplary embodiment of the drilling apparatus (20), the circumferential track (140) defines a plurality of first positions (142) which correspond to the axial first mandrel position and a plurality of second positions (144) which correspond to the axial second mandrel position. In the exemplary embodiment of the drilling apparatus (20), the plurality of first positions (142) and second positions (144) alternate along the circumferential track (140). In other embodiments, the circumferential track (140) may further define one or more intermediate positions between the first position (142) and the second position (144), which may correspond to additional axial mandrel positions of the mandrel (116).

In the exemplary embodiment of the drilling apparatus (20), during normal drilling conditions the barrel cam pin (138) will be positioned either at one of the first positions (142) or one of the second positions (144) as a result of the biasing force provided by the mandrel biasing device (128). When the pressure and/or flow of the circulating fluid passing through the drilling apparatus (20) increases above the pressure and/or flow during normal drilling conditions such that the biasing force provided by the mandrel biasing device (128) is overcome, the barrel cam pin (138) moves out of the first position (142) or the second position (144) and travels along the circumferential track (140). When the increased pressure and/or flow of the circulating fluid ceases, the barrel cam pin (138) will travel along the circumferential track (140) to the next first position (142) or second position (144) in order to achieve and maintain either the axial first mandrel position or the axial second mandrel position.

Referring to FIGS. 2 and 3D, in the exemplary embodiment of the drilling apparatus (20), the rotation restraining device (42) comprises a plurality of borehole engagement members (90). As depicted in FIGS. 2 and 3D, the borehole engagement members (90) comprise blocks. In other embodiments, the plurality of borehole engagement members (90) may comprise blades, pads or some other suitable structure, device, or apparatus.

In the exemplary embodiment of the drilling apparatus (20), the plurality of borehole engagement members (90) are radially movable by the rotation restraining device actuator (46) to actuate the rotation restraining device (42) between the retracted position and the extended position. In the extended position, rotation of the drilling assembly housing (32) relative to the borehole may be inhibited in part by friction between the plurality of borehole engagement members (90) and the borehole wall produced by pushing the plurality of borehole engagement members (90) against the borehole wall. FIGS. 3A-3F depict the rotation restraining device (42) in the extended position.

As depicted in FIGS. 2 and 3D, in the exemplary embodiment of the drilling apparatus (20), each borehole engagement member (90) comprises a radial extension member (94). The radial extension member (94) may assist the rotation restraining device (42) in maintaining contact with the borehole wall and may assist in providing a constant force against the borehole wall.

The radial extension members (94) may be extendably biased. In the exemplary embodiment of the drilling apparatus (20), each of the radial extension members (94) is extendably biased by an extension member biasing device (96). As depicted in FIGS. 2 and 3D, each extension member biasing device (96) comprises two helical springs. The springs may be selected to provide a desired pre-load to help control the minimum and maximum contact force with the borehole wall. In other embodiments, the extension member biasing device (96) may comprise any number of springs and any type of springs and/or the extension member biasing device (96) may comprise any other suitable structure, device, or apparatus. In the exemplary embodiment of the drilling apparatus (20), each borehole engagement member (90) comprises two cavities (98) defined in the borehole engagement member (90) for carrying the two helical springs.

In the exemplary embodiment of the drilling apparatus (20), the outer surface of each borehole engagement member (90) comprises a borehole engagement surface (100) for contacting a borehole wall when the rotation restraining device (42) is in the extended position. In the exemplary embodiment of the drilling apparatus (20), the borehole engagement surfaces (100) are provided by engagement inserts (102) which are mounted in the outer surface of each of the radial extension members (94) for enhancing the engagement between the rotation restraining device (42) and the borehole wall by increased friction and/or by penetration of the borehole wall.

Referring to FIG. 3D, in the exemplary embodiment of the drilling apparatus (20), the rotation restraining device actuator (46) comprises a ramp (106) defining a plurality of inclined ramp surfaces (108). In the exemplary embodiment of the drilling apparatus (20), the ramp (106) and the plurality of borehole engagement members (90) define complementary inclined surfaces (110) so that the plurality of borehole engagement members (90) are radially movable by the ramp (106) to actuate the rotation restraining device (42) between the retracted position and the extended position.

In the exemplary embodiment, the ramp (106) is positioned within the apparatus bore (76) and is axially movable within the apparatus bore (76) relative to the plurality of borehole engagement members (90) in order to actuate the rotation restraining device (42) between the retracted position and the extended position.

The rotation restraining device actuator (46) may further comprise additional components for axially moving the ramp (106) within the apparatus bore (76). In some embodiments of the drilling apparatus (20), the swivel actuator (44) and the rotation restraining device actuator (46) may be separate from each other and/or may operate independently so that some functions of the actuators (44, 46) may be duplicated in the drilling apparatus (20). Alternatively, in some embodiments of the drilling apparatus (20), the swivel actuator (44) and the rotation restraining device actuator (46) may share some components in order to avoid duplication and/or in order to coordinate the actuation of the swivel (40) and the rotation restraining device (42).

In the exemplary embodiment of the drilling apparatus (20), the rotation restraining device actuator (46) further comprises components of the swivel actuator (44) as previously described, including the mandrel (116), the mandrel biasing device (128), and the indexing mechanism (132), with the result that the mandrel (116), the mandrel biasing device (128), and the indexing mechanism (132) are shared between the swivel actuator (44) and the rotation restraining device actuator (46).

More particularly, referring to FIGS. 3A-3F, in the exemplary embodiment of the drilling apparatus (20), the swivel actuator (44) and the rotation restraining device actuator (46) comprise a combined actuator (114). In the exemplary embodiment of the drilling apparatus (20), the combined actuator (114) combines some functions and features of the swivel actuator (44) and the rotation restraining device actuator (46) as previously described.

In the exemplary embodiment of the drilling apparatus (20) comprising the combined actuator (114), the locking element (70) and the ramp (106) are both associated with the mandrel (116) such that axial movement of the mandrel (116) causes axial movement of both the locking element (70) and the ramp (106). As previously described, in the exemplary embodiment of the drilling apparatus (20), the locking element (70) is connected with the mandrel (116) by the coupler (120) so that axial movement of the mandrel (116) causes axial movement of the locking element (70). In addition, in the exemplary embodiment of the drilling apparatus (20), the ramp (106) is integrally formed with the mandrel (116) so that axial movement of the mandrel (116) causes axial movement of the ramp (106).

In the exemplary embodiment of the drilling apparatus (20) comprising the combined actuator (114), when the mandrel (116) is in the axial first mandrel position, the swivel (40) is in the locked position and the rotation restraining device (42) is in the retracted position. In the exemplary embodiment of the drilling apparatus (20) comprising the combined actuator (114), when the mandrel (116) is in the axial second mandrel position, the swivel (40) is in the unlocked position and the rotation restraining device (42) is in the extended position. FIGS. 3A-3F depict the mandrel (116) in the axial second mandrel position wherein the swivel (40) is in the unlocked position and the rotation restraining device (42) is in the extended position.

In the exemplary embodiment of the drilling apparatus (20), some components of the drilling apparatus (20) are isolated from a circulating fluid passing through the drilling apparatus (20) and are immersed in lubricating fluid compartments containing a suitable lubricating fluid such as an oil. In the exemplary embodiment of the drilling apparatus (20), the drilling apparatus (20) comprises one or more seals and/or seal assemblies for defining the lubricating fluid compartments.

Referring to FIGS. 3A and 3B, a proximal lubricating fluid compartment (146) is axially defined between a proximal rotary seal assembly (150) and a proximal balance piston (147). Referring to FIG. 3A, the proximal rotary seal assembly (150) comprises a rotary seal housing (152), a mud barrier seal (154), and an oil/oil pressure seal (156). In other embodiments of the drilling apparatus (20), the proximal seal assembly (150) may be modified, simplified, or substituted for a seal assembly at a different axial location in the drilling apparatus (20). Referring to FIG. 3B, seals (157) are provided on the proximal balance piston (147) to seal the apparatus bore (76) between the drilling apparatus housing (28) and the locking element (70). The proximal lubricating fluid compartment (146) may be filled with oil via a proximal oil fill port (not shown) in the drilling apparatus housing (28).

In the exemplary embodiment of the drilling apparatus (20), some parts of the swivel (40) and the combined actuator (114) are contained in the proximal lubricating fluid compartment (146).

Referring to FIGS. 3B and 3E, a distal lubricating fluid compartment (148) is axially defined between the upper mandrel piston (122) and a distal balance piston (149). Referring to FIG. 3B, seals (158) are provided on the upper mandrel piston (122) to seal the interface between the drilling apparatus housing (28) and the upper mandrel piston (122). Referring to FIG. 3E, seals (159) are provided on the distal balance piston (149) to seal the apparatus bore (76) between the drilling apparatus housing (28) and the mandrel (116). Referring to FIG. 3D, seals (160) are provided on the borehole engagement members (100) to seal the interface between the drilling apparatus housing (28) and the borehole engagement members (100). The distal lubricating fluid compartment (148) may be filled with oil via a distal oil fill port (not shown) in the drilling apparatus housing (28).

In the exemplary embodiment of the drilling apparatus (20), some parts of the rotation restraining device (42) and the combined actuator (114) are contained in the distal lubricating fluid compartment (148).

Referring to FIGS. 3B and 3E, in the exemplary embodiment of the drilling apparatus (20), the drilling apparatus (20) comprises pressure balancing systems associated with each of the lubricating fluid compartments (146, 148). More particularly, in the exemplary embodiment of the drilling apparatus (20), the drilling apparatus (20) comprises a proximal pressure balancing system (162) which is associated with the proximal lubricating fluid compartment (146) and a distal pressure balancing system (163) which is associated with the distal lubricating fluid compartment (148).

Referring to FIG. 3B, the proximal pressure balancing system (162) comprises the proximal balance piston (147) and the mandrel ports (118). One end of the proximal balance piston (147) is in pressure communication with the mandrel bore (118) via the mandrel ports (124) and the other end of the proximal balance piston (147) is in pressure communication with the proximal lubricating fluid compartment (146).

Referring to FIG. 3E, the distal pressure balancing system (163) comprises the distal balance piston (149) and a distal pressure balancing port (164). One end of the distal balance piston (149) is in pressure communication with the exterior of the drilling apparatus housing (28) via the distal pressure balancing port (164) and the other end of the distal balance piston (149) is in pressure communication with the distal lubricating fluid compartment (148).

In embodiments of the drilling apparatus (20) in which isolated lubricating fluid compartments are not provided, the seals and/or sealing assemblies and the pressure balancing systems may be modified, simplified, or may in some cases be omitted altogether.

The drilling apparatus (20) may comprise one or more bearing assemblies for transmitting axial and/or radial loads through the drilling apparatus (20).

Referring to FIG. 3A, in the exemplary embodiment of the drilling apparatus (20), the drilling apparatus (20) comprises a swivel bearing assembly (165) which is interposed between the proximal swivel component (50) and the distal swivel component (52). The swivel bearing assembly (165) comprises a swivel bearing housing (166), at least one radial bearing (167), at least one thrust bearing (168), and a shaft catch (169) for preventing the proximal swivel component (50) from being separated from the other components of the drilling apparatus (20). In the exemplary embodiment of the drilling apparatus (20), one end of the swivel bearing housing (166) is connected with the rotary seal housing (152) and the other end of the swivel bearing housing (166) is connected with the proximal end (62) of the distal swivel component (52). In other embodiments of the drilling apparatus (20), the swivel bearing assembly (165) may be modified or simplified.

In some embodiments, the drilling apparatus (20) may comprise one or more bearing assemblies (not shown) in addition to or in substitution for the swivel bearing assembly (165). As non-limiting examples, one or more bearing assemblies (not shown) may be located proximal to, distal to, or within the drilling assembly (30).

In some embodiments of the drilling apparatus (20), the drilling apparatus may comprise one or more signaling devices for generating and/or providing signals relating to the operation of the drilling apparatus (20). Referring to FIG. 3F, in the exemplary embodiment of the drilling apparatus (20), the drilling apparatus (20) comprises a signaling device (176) for indicating the actuation state of the swivel (40) and the rotation restraining device (42). In the exemplary embodiment of the drilling apparatus (20), the signaling device (176) comprises a variable choke device comprising an orifice (178) and a choke member (180).

The orifice (178) and the choke member (180) are movable relative to one another to provide a varying restriction of flow of a circulating fluid through the orifice (178). In the exemplary embodiment of the drilling apparatus (20), an end of the mandrel (116) comprises the orifice (178), and the choke member (180) is fixedly mounted within the apparatus bore (76) proximate the end of the mandrel (116), such that axial movement of the mandrel (116) varies the relative axial positions of the orifice (178) and the choke member (180), and such that the flow of a circulating fluid through the mandrel bore (118) is restricted by varying amounts depending upon the axial position of the mandrel (116). A change in the restriction of the flow results in a pressure variation, generating a pressure signal which can be sensed in order to determine the actuation state of the swivel (40) and the rotation restraining device (42).

Figure 7:
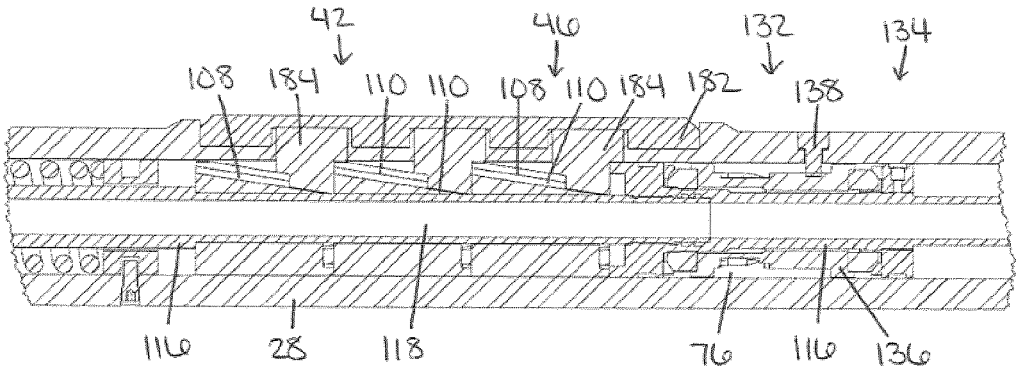
FIG. 7 is an isolated longitudinal section assembly view of a first alternate embodiment of a rotation restraining device and a rotation restraining device actuator for use in a drilling apparatus of the type depicted in FIG. 2.

FIG. 7 depicts a first alternate embodiment of a rotation restraining device (42) and a rotation restraining device actuator (46) which may be used in the drilling apparatus (20). In the first alternate embodiment, the rotation restraining device (42) comprises a borehole engagement member (90) comprising a pad (182) carried by three pistons (184). The ramp (106) and each of the pistons (180) comprise complementary inclined surfaces (110) so that the borehole engagement member (90) is radially movable by the ramp (106) in order to actuate the rotation restraining device (42) between the retracted position and the extended position. As depicted in FIG. 7, in the first alternate embodiment, the ramp (106) is not integral with the mandrel (116) but is mounted on the mandrel (116).

Figure 8:
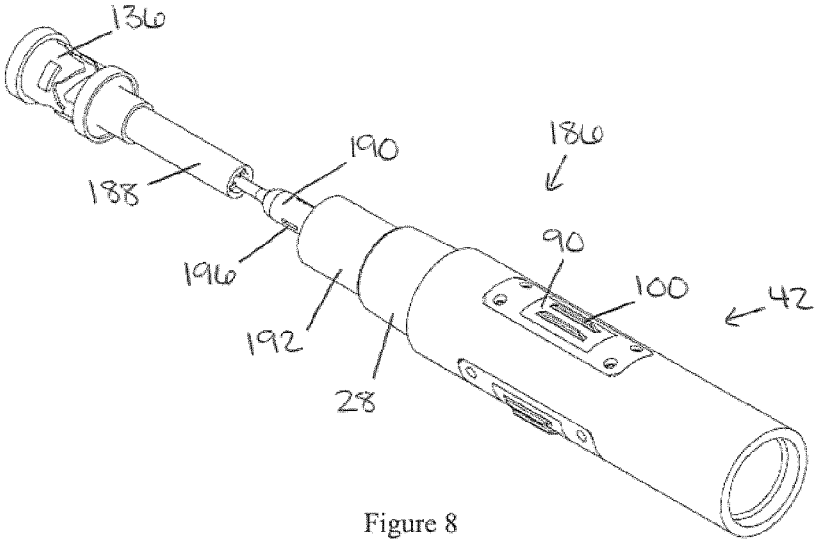
FIG. 8 is a pictorial view of components of a second alternate embodiment of a rotation restraining device and a rotation restraining device actuator for use in a drilling apparatus of the type depicted in FIG. 2.
Figure 9A:
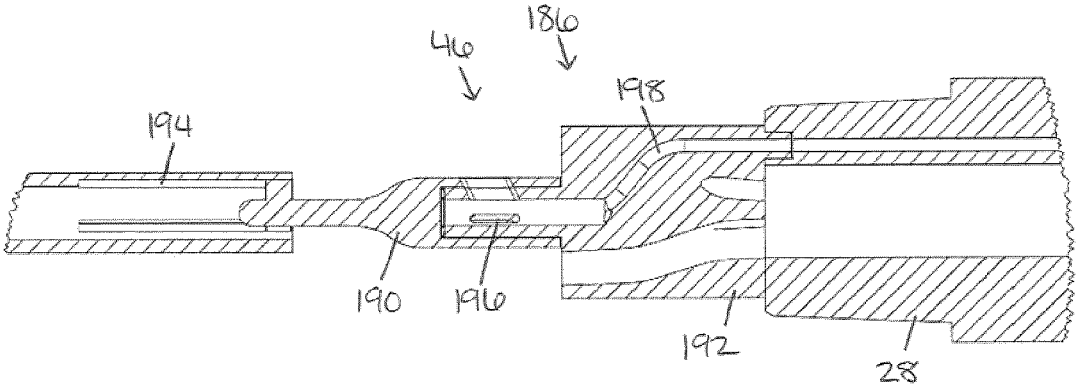
Figure 9B:
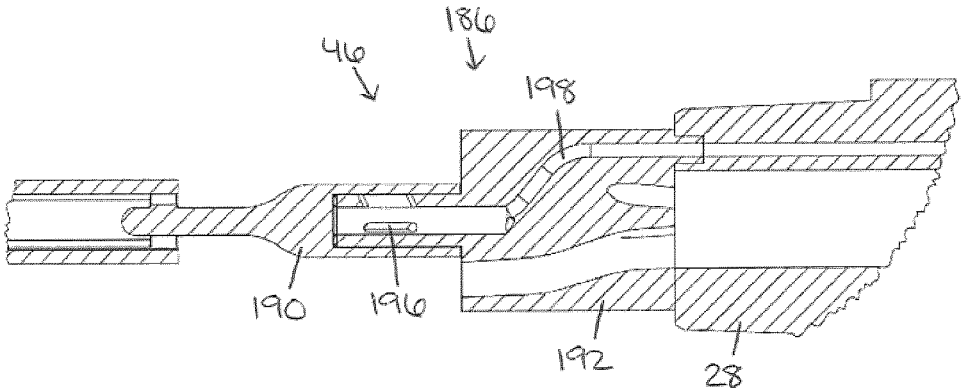
Figure 10:
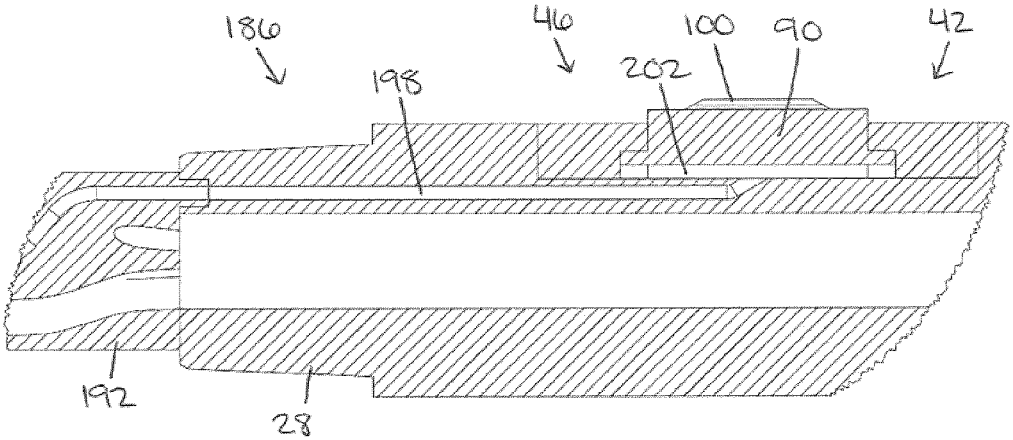
FIG. 10 is a longitudinal section assembly view of components of the rotation restraining device depicted in FIG. 8, wherein the rotation restraining device is shown actuated to the extended position.

FIGS. 8-10 depict a second alternate embodiment of a rotation restraining device (42) and a rotation restraining device actuator (46). In the second alternate embodiment, the rotation restraining device (42) comprises a plurality of borehole engagement members (90). The outer surface of each of the borehole engagement members (90) comprises a borehole engagement surface (100). In the second alternate embodiment, the rotation restraining device actuator (46) comprises a valve mechanism (186) for selectively delivering a fluid actuating pressure to the rotation restraining device (42) in order to actuate the rotation restraining device (42) between the retracted position and the extended position. In the second alternate embodiment of the rotation restraining device (42), the fluid actuating pressure is derived from a circulating fluid such as a drilling fluid passing through the drilling apparatus (20).

In the second alternate embodiment, the valve mechanism (186) comprises a rotary sleeve shaft (188), a rotary sleeve (190), and a flow manifold (192). The rotary sleeve shaft (188) is keyed to the barrel cam (134) so that the rotary sleeve shaft (188) rotates with the barrel cam (134). The rotary sleeve shaft (188) and the rotary sleeve (190) are connected with complementary splines (194) so that the rotary sleeve (190) rotates with the barrel cam (134) relative to the flow manifold (192). The valve mechanism (186) further comprises one or more slots (196) defined by the rotary sleeve (190) and a valve mechanism port (198) defined by the flow manifold (192). The one or more slots (196) and the valve mechanism port (186) move into and out of circumferential alignment as the rotary sleeve (190) rotates relative to the flow manifold (192). When the one or more slots (196) are in circumferential alignment with the valve mechanism port (186), the mandrel bore (118) is in fluid communication with the valve mechanism port (198).

As depicted in FIG. 10, the second alternate embodiment further comprises an actuation chamber (202) which is in pressure communication with both the valve mechanism (186) and the plurality of borehole engagement members (90). The actuation chamber (202) is in fluid communication with the valve mechanism (186) via the valve mechanism port (198).

The valve mechanism (186) may be actuated between an open position, as depicted in FIG. 9A, and a closed position, as depicted in FIG. 9B. In the open position, a portion of a circulating fluid passing through the mandrel bore (118) is redirected in order to deliver a first fluid actuating pressure to the actuation chamber (202) so that the rotation restraining device (42) is actuated to the extended position as depicted in FIG. 10. In the closed position, the portion of the fluid passing through the mandrel bore (118) is not redirected in order to deliver a second fluid actuating pressure to the actuation chamber (202) so that the rotation restraining device (42) is actuated to the retracted position.

Figure 11:
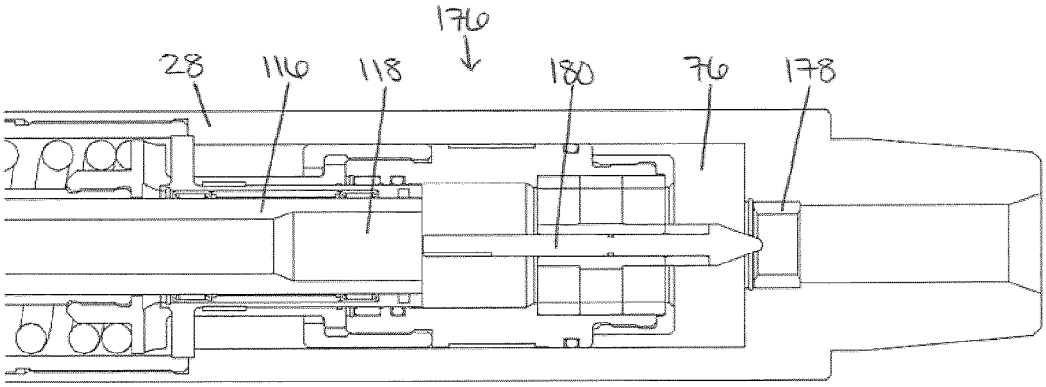
FIG. 11 is a longitudinal section assembly view of an alternate embodiment of a signal generation pressure drop device for use in a drilling apparatus of the type depicted in FIG. 2.

FIG. 11 depicts an alternate embodiment of the signaling device (176). In the alternate embodiment, an end of the mandrel (116) comprises the choke member (180), and the orifice (178) is fixedly mounted within the apparatus bore (76) proximate the end of the mandrel (116), such that axial movement of the mandrel (116) results in a variation in the relative axial positions of the orifice (178) and the choke member (180), and such that the flow of a circulating fluid through the mandrel bore (118) is restricted by varying amounts depending upon the axial position of the mandrel (116).

Figure 12:
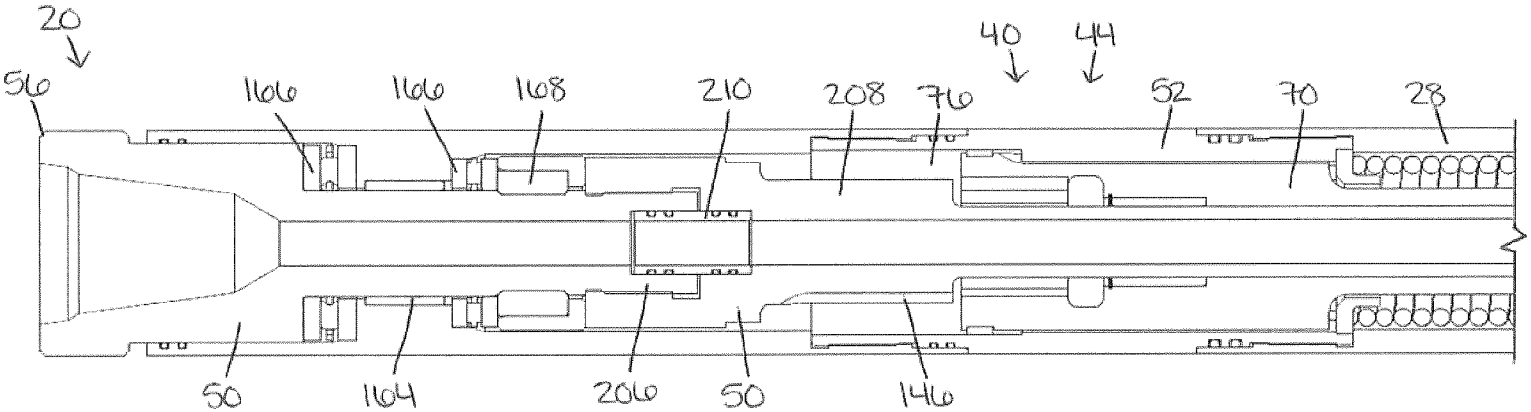
FIG. 12 is a longitudinal section assembly view of a first alternate exemplary embodiment of a bearing configuration for use in a drilling apparatus of the type depicted in FIG. 2.

FIG. 12 depicts a first alternate exemplary embodiment of a swivel bearing configuration for the drilling apparatus (20). In the first alternate embodiment, the proximal swivel component (50) comprises a first proximal swivel component (206) and a second proximal swivel component (208) connected by a joint (210). The joint (210) may connect the first proximal swivel component (206) and the second proximal swivel component (208) by threads or by an interference fit. In the first alternate embodiment, a radial bearing (164) and two thrust bearings (166) are axially located along the first proximal swivel component (206) and the locking element (70) is axially located along the second proximal swivel component (208).

Figure 13:
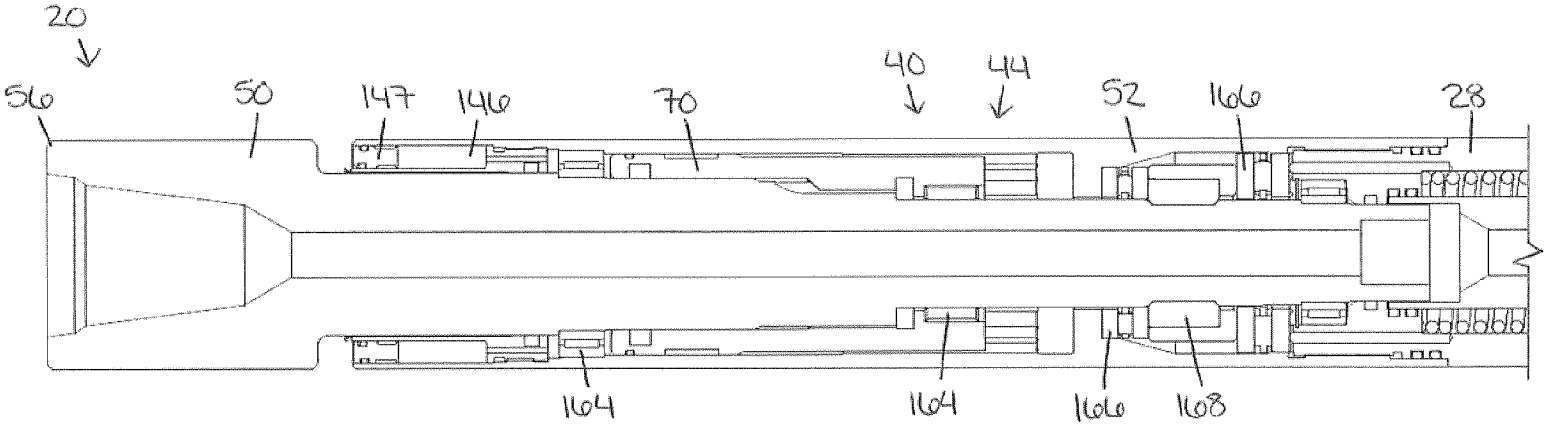
FIG. 13 is a longitudinal section assembly view of a second alternate exemplary embodiment of a bearing configuration for use in a drilling apparatus of the type depicted in FIG. 2.

FIG. 13 depicts a second alternate exemplary embodiment of a swivel bearing configuration of the drilling apparatus (20). In the second alternate embodiment, a radial bearing (164) is axially located on either side of the locking element (70) and a thrust bearing (166) is axially located on either side of the shaft catch (168). In the second alternate embodiment, the proximal balance piston (147) is axially located at the proximal end (62) of the distal swivel component (52).

Figure 14:
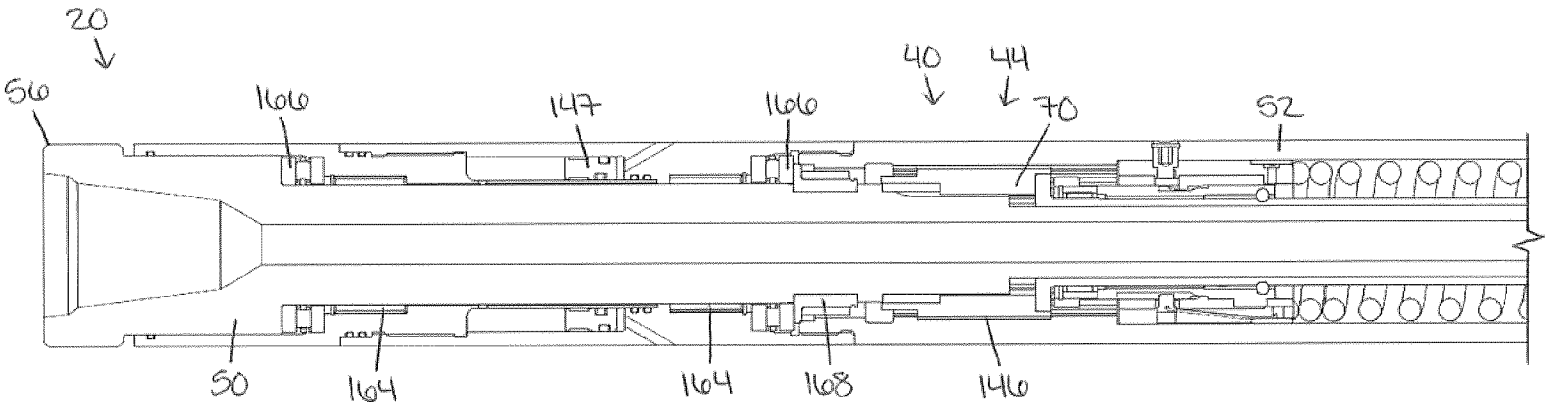
FIG. 14 is a longitudinal section assembly view of a third alternate exemplary embodiment of a bearing configuration for use in a drilling apparatus of the type depicted in FIG. 2.

FIG. 14 depicts a third alternate exemplary embodiment of a swivel bearing configuration of the drilling apparatus (20). In the third alternate embodiment, two radial bearings (164) and two thrust bearings (166) are axially located between the locking element (70) and the proximal end (56) of the proximal swivel component (50). In the third alternate embodiment, the proximal balance piston (147) is axially located between the two radial bearings (164).

Figure 15:
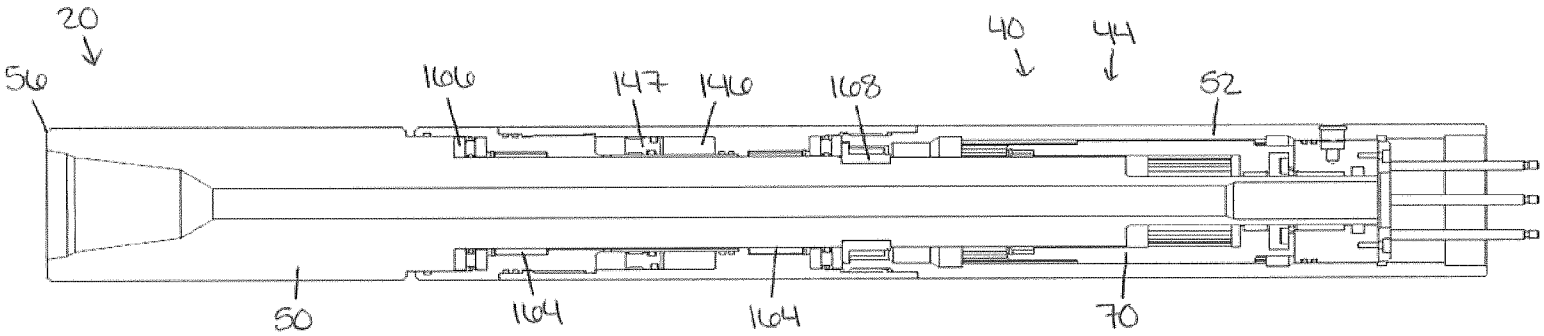
FIG. 15 is a longitudinal section assembly view of a fourth alternate exemplary embodiment of a bearing configuration for use in a drilling apparatus of the type depicted in FIG. 2.

FIG. 15 depicts a fourth alternate exemplary embodiment of a swivel bearing configuration of the drilling apparatus (20). In the fourth alternate embodiment, two radial bearings (164) and a thrust bearing (166) are axially located between the locking element (70) and the proximal end (56) of the proximal swivel component (50). In the fourth alternate embodiment, the proximal balance piston (147) is axially located between the two radial bearings (164).

The following are non-limiting, specific embodiments of the apparatus described herein:

Embodiment A. A drilling apparatus connectable with a drill pipe and connectable with a drilling assembly comprising a drilling assembly housing, for use in drilling a borehole, comprising:

- a rotation restraining device actuatable between a retracted position and an extended position, wherein the rotation restraining device is connected with the drilling assembly housing such that rotation of the drilling assembly housing relative to the borehole is inhibited when the drilling apparatus is in the borehole and the rotation restraining device is in the extended position;
- a rotation restraining device actuator for actuating the rotation restraining device between the retracted position and the extended position;
- a swivel actuatable between a locked position and an unlocked position, wherein the drilling assembly housing is rotatable with the drill pipe when the swivel is in the locked position, and wherein the drill pipe is rotatable relative to the drilling assembly housing when the swivel is in the unlocked position; and
- a swivel actuator for actuating the swivel between the locked position and the unlocked position.

Embodiment B. The drilling apparatus of Embodiment A, wherein the drilling apparatus comprises the drilling assembly.

Embodiment C. The drilling apparatus of Embodiment A or B, wherein the drilling assembly comprises a directional drilling assembly for use in directional drilling.

Embodiment D. The drilling apparatus of any one of Embodiments A to C, wherein the swivel comprises a proximal swivel component non-rotatably connectable with the drill pipe and a distal swivel component non-rotatably connected with the drilling assembly housing, wherein the proximal swivel component is non-rotatably connected with the distal swivel component when the swivel is in the locked position, and wherein the proximal swivel component is rotatably connected with the distal swivel component when the swivel is in the unlocked position.

Embodiment E. The drilling apparatus of Embodiment D, wherein the swivel actuator comprises a locking element which non-rotatably connects the proximal swivel component with the distal swivel component when the swivel is in the locked position.

Embodiment F. The drilling apparatus of Embodiment E, wherein the locking element is movable relative to at least one of the proximal swivel component and the distal swivel component to actuate the swivel between the locked position and the unlocked position.

Embodiment G. The drilling apparatus of Embodiment E or F, wherein the locking element is non-rotatably connected with one of the proximal swivel component and the distal swivel component when the swivel is in both the locked position and the unlocked position, and wherein the locking element is non-rotatably connected with both the proximal swivel component and the distal swivel component when the swivel is in the locked position.

Embodiment H. The drilling apparatus of any one of Embodiments E to G, wherein the locking element comprises a locking element engagement surface, wherein the swivel comprises a swivel component engagement surface, wherein the locking element engagement surface is engaged with the swivel component engagement surface when the swivel is in the locked position, and wherein the locking element engagement surface is disengaged from the swivel component engagement surface when the swivel is in the unlocked position.

Embodiment I. The drilling apparatus of Embodiment H, wherein the locking element engagement surface and the swivel component engagement surface comprise complementary splines.

Embodiment J. The drilling apparatus of any one of Embodiments E to I, wherein the locking element is axially movable relative to at least one of the proximal swivel component and the distal swivel component to actuate the swivel between the locked position and the unlocked position.

Embodiment K. The drilling apparatus of any one of Embodiments E to J, wherein the drilling apparatus defines an apparatus bore, wherein the swivel actuator comprises a mandrel positioned within the apparatus bore, wherein the locking element is positioned within the apparatus bore, and wherein the locking element is movable by the mandrel to actuate the swivel between the locked position and the unlocked position.

Embodiment L. The drilling apparatus of Embodiment K, wherein the mandrel is axially movable within the apparatus bore.

Embodiment M. The drilling apparatus of Embodiment K, wherein the mandrel is axially movable within the apparatus bore in response to circulating a circulating fluid through the drilling apparatus.

Embodiment N. The drilling apparatus of any one of Embodiments K to M, wherein the swivel is in the locked position when the mandrel is in an axial first mandrel position, and wherein the swivel is in the unlocked position when the mandrel is in an axial second mandrel position.

Embodiment O. The drilling apparatus of any one of Embodiments K to N, wherein the swivel actuator comprises an indexing mechanism for maintaining the mandrel in the axial first mandrel position and the axial second mandrel position.

Embodiment P. The drilling apparatus of Embodiment O, wherein the indexing mechanism comprises a barrel cam assembly comprising a barrel cam and a barrel cam pin, and wherein the barrel cam is axially movable and rotatable relative to the barrel cam pin.

Embodiment Q. The drilling apparatus of Embodiment P, wherein the barrel cam assembly is positioned within the apparatus bore, and wherein the barrel cam is axially movable by the mandrel.

Embodiment R. The drilling apparatus of any one of Embodiments A to Q, wherein the rotation restraining device comprises at least one borehole engagement member, and wherein the at least one borehole engagement member is radially movable by the rotation restraining device actuator to actuate the rotation restraining device between the retracted position and the extended position.

Embodiment S. The drilling apparatus of Embodiment R, wherein the at least one borehole engagement member comprises a radial extension member, and wherein the radial extension member is extendably biased.

Embodiment T. The drilling apparatus of Embodiment R or S, wherein the rotation restraining device actuator comprises a ramp, wherein the ramp and the at least one borehole engagement member define complementary inclined surfaces, and wherein the at least one borehole engagement member is radially movable by the ramp to actuate the rotation restraining device between the retracted position and the extended position.

Embodiment U. The drilling apparatus of Embodiment T, wherein the ramp is axially movable relative to the at least one borehole engagement member.

Embodiment V. The drilling apparatus of Embodiment T or U, wherein the drilling apparatus defines an apparatus bore, wherein the rotation restraining device actuator comprises a mandrel positioned within the apparatus bore, wherein the ramp is positioned within the apparatus bore, and wherein the ramp is movable by the mandrel to actuate the rotation restraining device between the retracted position and the extended position.

Embodiment W. The drilling apparatus of Embodiment V, wherein the mandrel is axially movable within the apparatus bore.

Embodiment X. The drilling apparatus of Embodiment V, wherein the mandrel is axially movable within the apparatus bore in response to circulating a circulating fluid through the drilling apparatus.

Embodiment Y. The drilling apparatus of any one of Embodiments V to X, wherein the rotation restraining device is in the retracted position when the mandrel is in an axial first mandrel position, and wherein the rotation restraining device is in the extended position when the mandrel is in an axial second mandrel position.

Embodiment Z. The drilling apparatus of any one of Embodiments V to Y, wherein the swivel actuator comprises an indexing mechanism for maintaining the mandrel in the axial first mandrel position and the axial second mandrel position.

Embodiment AA. The drilling apparatus of Embodiment Z, wherein the indexing mechanism comprises a barrel cam assembly comprising a barrel cam and a barrel cam pin, and wherein the barrel cam is axially movable and rotatable relative to the barrel cam pin.

Embodiment BB. The drilling apparatus of Embodiment AA, wherein the barrel cam assembly is positioned within the apparatus bore, and wherein the barrel cam is axially movable by the mandrel.

Embodiment CC. The drilling apparatus of any one of Embodiments A to BB, wherein the rotation restraining device actuator and the swivel actuator comprise a combined actuator.

Embodiment DD. The drilling apparatus of Embodiment CC, wherein the combined actuator comprises a locking element which non-rotatably connects the proximal swivel component with the distal swivel component when the swivel is in the locked position.

Embodiment EE. The drilling apparatus of Embodiment CC or DD, wherein the rotation restraining device comprises at least one borehole engagement member, and wherein the at least one borehole engagement member is radially movable by the combined actuator to actuate the rotation restraining device between the retracted position and the extended position.

Embodiment FF. The drilling apparatus of Embodiment EE, wherein the combined actuator comprises a ramp, wherein the ramp and the at least one borehole engagement member define complementary inclined surfaces, and wherein the at least one borehole engagement member is radially movable by the ramp to actuate the rotation restraining device between the retracted position and the extended position.

Embodiment GG. The drilling apparatus of any one of Embodiments CC to FF, wherein the combined actuator comprises a locking element which non-rotatably connects the proximal swivel component with the distal swivel component when the swivel is in the locked position.

Embodiment HH. The drilling apparatus of Embodiment GG, wherein the drilling apparatus defines an apparatus bore, wherein the combined actuator comprises a mandrel positioned within the apparatus bore, wherein the locking element and the ramp are positioned within the apparatus bore, wherein the locking element is movable by the mandrel to actuate the swivel between the locked position and the unlocked position, and wherein the ramp is movable by the mandrel to actuate the rotation restraining device between the retracted position and the extended position.

Embodiment II. The drilling apparatus of Embodiment HH, wherein the mandrel is axially movable within the apparatus bore.

Embodiment JJ. The drilling apparatus of Embodiment HH, wherein the mandrel is axially movable within the apparatus bore in response to circulating a circulating fluid through the drilling apparatus.

Embodiment KK. The drilling apparatus of any one of Embodiments HH to JJ, wherein the swivel is in the locked position and the rotation restraining device is in the retracted position when the mandrel is in an axial first mandrel position, and wherein the swivel is in the unlocked position and the rotation restraining device is in the extended position when the mandrel is in an axial second mandrel position.

Embodiment LL. The drilling apparatus of any one of Embodiments HH to KK, wherein the combined actuator comprises an indexing mechanism for maintaining the mandrel in the axial first mandrel position and the axial second mandrel position.

Embodiment MM. The drilling apparatus of Embodiment LL, wherein the indexing mechanism comprises a barrel cam assembly comprising a barrel cam and a barrel cam pin, and wherein the barrel cam is axially movable and rotatable relative to the barrel cam pin.

Embodiment NN. The drilling apparatus of Embodiment MM, wherein the barrel cam assembly is positioned within the apparatus bore, and wherein the barrel cam is axially movable by the mandrel.

Embodiment OO. The drilling apparatus of any one of Embodiments A to NN, wherein the directional drilling assembly comprises a drilling motor.

Embodiment PP. The drilling apparatus of any one of Embodiments A to OO, wherein the directional drilling assembly defines a toolface direction for directional drilling.

Embodiment QQ. The drilling apparatus of any one of Embodiments A to PP, wherein the drilling apparatus comprises a proximal end and a distal end, and wherein the directional drilling assembly and the rotation restraining device are axially located between the swivel and the distal end of the drilling apparatus.

Embodiment RR. The drilling apparatus of any one of Embodiments A to QQ, wherein the rotation restraining device is axially located between the swivel and the directional drilling assembly.

Embodiment SS. A method for drilling a borehole, comprising:

connecting a drilling assembly with a drill pipe, wherein the drilling assembly comprises a drilling assembly housing;

drilling while rotating the drill pipe and thereby rotating the drilling assembly housing; and drilling while rotating the drill pipe relative to the drilling assembly housing.

Embodiment TT. The method of Embodiment SS, wherein drilling the borehole is performed using a drilling apparatus comprising:

the drilling assembly, wherein the drilling assembly comprises a directional drilling assembly;

a rotation restraining device actuatable between a retracted position and an extended position, wherein the rotation restraining device is connected with the drilling assembly housing such that rotation of the drilling assembly housing relative to the borehole is inhibited when the drilling apparatus is in the borehole and the rotation restraining device is in the extended position; and a swivel actuatable between a locked position and an unlocked position, wherein the drilling assembly housing is rotatable with the drill pipe when the swivel is in the locked position, and wherein the drill pipe is rotatable relative to the drilling assembly housing when the swivel is in the unlocked position.

Embodiment UU. The method of Embodiment SS or TT, comprising performing non-directional drilling when drilling while rotating the drill pipe and thereby rotating the drilling assembly housing, and comprising performing directional drilling when drilling while rotating the drill pipe relative to the drilling assembly housing.

Embodiment VV. The method of Embodiment TT or UU, wherein during the non-directional drilling the rotation restraining device is actuated to the retracted position and the swivel is actuated to the locked position, and wherein during the directional drilling the rotation restraining device is actuated to the extended position and the swivel is actuated to the unlocked position.

Embodiment WW. The method of any one of Embodiments TT to VV, comprising actuating the rotation restraining device to the retracted position and actuating the swivel to the locked position before commencing the non-directional drilling.

Embodiment XX. The method of any one of Embodiments TT to WW, wherein actuating the rotation restraining device to the retracted position and actuating the swivel to the locked position is performed while the drill pipe is not rotating.

Embodiment YY. The method of any one of Embodiments TT to VV, comprising actuating the rotation restraining device to the extended position and actuating the swivel to the unlocked position before commencing the directional drilling.

Embodiment ZZ. The method of any one of Embodiments TT to YY, wherein actuating the rotation restraining device to the extended position and actuating the swivel to the unlocked position is performed while the drill pipe is not rotating.

Embodiment AAA. The method of any one of Embodiments TT to YY, comprising actuating the rotation restraining device to the retracted position and actuating the swivel to the locked position before commencing the non-directional drilling.

Embodiment BBB. The method of any one of Embodiments SS to AAA, comprising repeating at least one of the non-directional drilling and the directional drilling.

Embodiment CCC. The method of any one of Embodiments TT to BBB, wherein actuating the rotation restraining device is performed by a rotation restraining device actuator.

Embodiment DDD. The method of Embodiment CCC, wherein the rotation restraining device actuator comprises a mandrel positioned within an apparatus bore of the drilling apparatus, and wherein actuating the rotation restraining device comprises moving the mandrel within the apparatus bore.

Embodiment EEE. The method of Embodiment CCC, wherein the rotation restraining device actuator comprises a mandrel positioned within an apparatus bore of the drilling apparatus, and wherein actuating the rotation restraining device comprises axially moving the mandrel within the apparatus bore.

Embodiment FFF. The method of Embodiment DDD or EEE, wherein the mandrel is axially moved within the apparatus bore in response to circulating a circulating fluid through the drilling apparatus.

Embodiment GGG. The method of any one of Embodiments TT to FFF, wherein actuating the swivel is performed by a swivel actuator.

Embodiment HHH. The method of Embodiment GGG, wherein the swivel actuator comprises a mandrel positioned within an apparatus bore of the drilling apparatus, and wherein actuating the swivel comprises moving the mandrel within the apparatus bore.

Embodiment III. The method of Embodiment GGG, wherein the swivel actuator comprises a mandrel positioned within an apparatus bore of the drilling apparatus, and wherein actuating the swivel comprises axially moving the mandrel within the apparatus bore.

Embodiment JJJ. The method of Embodiment HHH or III, wherein the mandrel is axially moved within the apparatus bore in response to circulating a circulating fluid through the drilling apparatus.

Embodiment KKK. The method of any one of Embodiments TT to JJJ, wherein actuating the rotation restraining device and actuating the swivel is performed by a combined actuator.

Embodiment LLL. The method of Embodiment KKK, wherein the combined actuator comprises a mandrel positioned within an apparatus bore of the drilling apparatus, and wherein actuating the rotation restraining device and the swivel comprises moving the mandrel within the apparatus bore.

Embodiment MMM. The method of Embodiment KKK, wherein the combined actuator comprises a mandrel positioned within an apparatus bore of the drilling apparatus, and wherein actuating the rotation restraining device and the swivel comprises axially moving the mandrel within the apparatus bore.

Embodiment NNN. The method of any one of Embodiment LLL or MMM, wherein the mandrel is axially moved within the apparatus bore in response to circulating a circulating fluid through the drilling apparatus.

We claim:

1. A drilling apparatus connectable with a drill pipe, the drilling apparatus comprising:

a drilling apparatus housing defining an apparatus bore;

a rotation restraining device actuatable between a retracted position and an extended position, wherein the rotation restraining device is connected with a drilling assembly housing of a drilling assembly such that rotation of the drilling assembly housing is inhibited when the drilling apparatus is in a borehole and the rotation restraining device is in the extended position;

a swivel actuatable between a locked position and an unlocked position, wherein the drilling assembly housing is rotatable with the drill pipe when the swivel is in the locked position, and wherein the drill pipe is rotatable relative to the drilling assembly housing when the swivel is in the unlocked position; and an actuator device comprising a mandrel axially movable within the apparatus bore, wherein axial movement of the mandrel actuates the rotation restraining device between the retracted position and the extended position and actuates the swivel between the locked position and the unlocked position.

2. The drilling apparatus as claimed in claim 1, wherein axial movement of the mandrel to a first axial mandrel position actuates the rotation restraining device to the retracted position and actuates the swivel to the locked position, and axial movement of the mandrel to a second axial mandrel position actuates the rotation restraining device to the extended position and actuates the swivel to the unlocked position.

3. The drilling apparatus as claimed in claim 2, wherein the drilling assembly comprises a directional drilling assembly for use in directional drilling.

4. The drilling apparatus as claimed in claim 3, wherein the swivel comprises a proximal swivel component non-rotatably connectable with the drill pipe and a distal swivel component non-rotatably connected with the drilling assembly housing, wherein the proximal swivel component is non-rotatably connected with the distal swivel component when the swivel is in the locked position, and wherein the proximal swivel component is rotatably connected with the distal swivel component when the swivel is in the unlocked position.

5. The drilling apparatus as claimed in claim 4, wherein the actuator device further comprises a locking element movable by axial movement of the mandrel which non-rotatably connects the proximal swivel component with the distal swivel component when the swivel is in the locked position.

6. The drilling apparatus as claimed in claim 5, wherein the locking element is movable relative to at least one of the proximal swivel component and the distal swivel component to actuate the swivel between the locked position and the unlocked position.

7. The drilling apparatus as claimed in claim 5, wherein the locking element is non-rotatably connected with one of the proximal swivel component and the distal swivel component when the swivel is in both the locked position and the unlocked position, and wherein the locking element is non-rotatably connected with both the proximal swivel component and the distal swivel component when the swivel is in the locked position.

8. The drilling apparatus as claimed in claim 6, wherein the locking element is positioned within the apparatus bore, and wherein the locking element is movable by the mandrel to actuate the swivel between the locked position and the unlocked position.

9. The drilling apparatus as claimed in claim 5, wherein the locking element comprises a locking element engagement surface, wherein the swivel comprises a swivel component engagement surface, wherein the locking element engagement surface is engaged with the swivel component engagement surface when the swivel is in the locked position, and wherein the locking element engagement surface is disengaged from the swivel component engagement surface when the swivel is in the unlocked position.

10. The drilling apparatus as claimed in claim 9, wherein the locking element engagement surface and the swivel component engagement surface comprise complementary splines.

11. The drilling apparatus as claimed in claim 10, wherein the locking element is axially movable relative to at least one of the proximal swivel component and the distal swivel component to actuate the swivel between the locked position and the unlocked position.

12. The drilling apparatus as claimed in claim 1, wherein the rotation restraining device comprises at least one borehole engagement member, and wherein the at least one borehole engagement member is radially movable by the actuator device to actuate the rotation restraining device between the retracted position and the extended position.

13. The drilling apparatus as claimed in claim 12, wherein the at least one borehole engagement member comprises a radial extension member, and wherein the radial extension member is extendably biased.

14. The drilling apparatus as claimed in claim 12, wherein the actuator device further comprises a ramp movable by axial movement of the mandrel, wherein the ramp and the at least one borehole engagement member define complementary inclined surfaces, and wherein the at least one borehole engagement member is radially movable by the ramp to actuate the rotation restraining device between the retracted position and the extended position.

15. The drilling apparatus as claimed in claim 14, wherein the ramp is axially movable relative to the at least one borehole engagement member.

16. The drilling apparatus as claimed in claim 14, wherein the ramp is positioned on the mandrel within the apparatus bore, and wherein the ramp is movable by the mandrel to actuate the rotation restraining device between the retracted position and the extended position.

17. The drilling apparatus as claimed in claim 16, wherein the mandrel is axially movable within the apparatus bore in response to circulating a circulating fluid through the drilling apparatus.

18. The drilling apparatus as claimed in claim 3, wherein the directional drilling assembly comprises a drilling motor.

19. The drilling apparatus as claimed in claim 18, wherein the directional drilling assembly defines a toolface direction for directional drilling.

20. The drilling apparatus as claimed in claim 3, wherein the drilling apparatus comprises a proximal end and a distal end, and wherein the directional drilling assembly and the rotation restraining device are axially located between the swivel and the distal end of the drilling apparatus.

21. The drilling apparatus as claimed in claim 20, wherein the rotation restraining device is axially located between the swivel and the directional drilling assembly.

22. The drilling apparatus as claimed in claim 2, wherein the actuator device further comprises an indexing mechanism for maintaining the mandrel in the first axial mandrel position and the second axial mandrel position.

23. The drilling apparatus as claimed in claim 22, wherein the indexing mechanism comprises a barrel cam assembly comprising a barrel cam and a barrel cam pin, and wherein the barrel cam is axially movable and rotatable relative to the barrel cam pin.

24. The drilling apparatus as claimed in claim 23, wherein the barrel cam assembly is positioned within the apparatus bore, and wherein the barrel cam is axially movable by the mandrel.

25. The drilling apparatus as claimed in claim 1, wherein the mandrel is axially movable within the apparatus bore in response to circulating a circulating fluid through the drilling apparatus.

26. A method of using the drilling apparatus of claim 1, the drilling apparatus being connected to a drilling assembly and a drill pipe, the method comprising:

moving the mandrel of the actuator device to a first axial mandrel position that actuates the rotation restraining device to the retracted position and actuating the swivel to the locked position; and moving the mandrel of the actuator device to a second axial mandrel position that actuates the rotation restraining device to the extended position and actuating the swivel to the unlocked position.

27. The method of claim 26, further comprising non-directional drilling while the rotation restraining device is in the retracted position and the swivel is in the locked position.

28. The method of claim 27, further comprising directional drilling while the rotation restraining device is in the extended position and the swivel is in the unlocked position.

29. The method as claimed in claim 26, wherein the mandrel is axially moved within the apparatus bore in response to circulating a circulating fluid through the drilling apparatus.

30. The method as claimed in claim 26, wherein moving the mandrel to the first axial mandrel position and moving the mandrel to the second axial mandrel position is performed when drill pipe is not rotating.

* * * * *